US011019933B2

(12) United States Patent
Greenhalgh et al.

(10) Patent No.: US 11,019,933 B2
(45) Date of Patent: Jun. 1, 2021

(54) BEDS

(71) Applicant: Ammique Limited, Bath (GB)

(72) Inventors: Marlene Claire Greenhalgh, Radstock (GB); Colin Jack Greenhalgh, Radstock (GB)

(73) Assignee: AMMIQUE LIMITED, Midsomer Norton (GB)

( * ) Notice: Subject to any disclaimer, the term of this patent is extended or adjusted under 35 U.S.C. 154(b) by 404 days.

(21) Appl. No.: 15/743,992

(22) PCT Filed: Jul. 12, 2016

(86) PCT No.: PCT/GB2016/052100

§ 371 (c)(1),
(2) Date: Jan. 11, 2018

(87) PCT Pub. No.: WO2017/009631

PCT Pub. Date: Jan. 19, 2017

(65) Prior Publication Data

US 2018/0199726 A1 Jul. 19, 2018

(30) Foreign Application Priority Data

Jul. 14, 2015 (GB) ..... 1512315

(51) Int. Cl.
*A47C 23/00* (2006.01)
*A47C 23/043* (2006.01)
*A47C 31/12* (2006.01)

(52) U.S. Cl.
CPC ..... *A47C 23/002* (2013.01); *A47C 23/0435* (2013.01); *A47C 31/123* (2013.01)

(58) Field of Classification Search
CPC . A47C 23/002; A47C 23/0435; A47C 31/123; A47C 23/12
See application file for complete search history.

(56) References Cited

U.S. PATENT DOCUMENTS 1,248,671 A * 12/1917 Kelly ..... B60N 2/502 267/131
1,475,010 A * 11/1923 Garbutt ..... A47C 23/002 5/258

(Continued)

FOREIGN PATENT DOCUMENTS

EP 2474251 7/2012
WO WO 2000/016664 3/2000

(Continued)

OTHER PUBLICATIONS

Search Report of GB1512315.1 dated Nov. 20, 2015, 4 pp.
International Search Report of PCT/GB2016/052100 dated Dec. 22, 2016, 4 pp.

*Primary Examiner* — Peter M. Cuomo
*Assistant Examiner* — Myles A Throop
(74) *Attorney, Agent, or Firm* — Lathrop GPM LLP

(57) ABSTRACT

The present invention relates to beds having a support surface defined by a plurality of support members (104, 204, 240). According to some aspects the support members are sprung (104, 204) and the bed includes a damping system (106, 206), for example a damping arm (124), for damping vibrations of the springs (118, 218). According to some aspects the support members (204, 240) have laterally extending pusher members (236, 238) arranged to engage with adjacent support members (204, 240); the pusher members (236, 238) comprising damping material (254). According to some aspects the support members (104, 204) are received by a guide member (320, 420) made up of two parts (320*a*, 320*b*, 420*a*, 420*b*) arranged to retain a spring by engaging between the coils of the spring (418). The present invention also relates to bed frames comprising a plurality of movable side elements (568, 768, 1068) mounted for movement in a direction substantially normal to the body support surface. The side elements (568, 768, 1068) are resiliently (Continued)

urged towards an unloaded position. The present invention also relates to methods of manufacturing beds.

18 Claims, 13 Drawing Sheets

(56) References Cited

U.S. PATENT DOCUMENTS

| | | | | |
|---|---|---|---|---|
| 3,656,190 | A * | 4/1972 | Regan | A47C 23/00 5/613 |
| 3,784,994 | A * | 1/1974 | Kery | A47C 23/002 5/710 |
| 3,999,234 | A * | 12/1976 | Regan | A47C 23/002 5/716 |
| 6,721,981 | B1 * | 4/2004 | Greenhalgh | A47C 23/002 5/253 |
| 10,010,187 | B1 * | 7/2018 | Mencio | A47C 7/35 |
| 10,588,420 | B1 * | 3/2020 | Krenik | A47C 23/002 |
| 2002/0162173 | A1 * | 11/2002 | Formenti | A47C 27/15 5/718 |
| 2004/0231057 | A1 * | 11/2004 | Sabin | A47C 31/08 5/716 |
| 2014/0137333 | A1 | 5/2014 | Defranks et al. | |
| 2014/0137337 | A1 * | 5/2014 | DeFranks | A47C 27/14 5/723 |
| 2015/0351982 | A1 * | 12/2015 | Krenik | A61G 7/018 5/616 |

FOREIGN PATENT DOCUMENTS

| | | |
|---|---|---|
| WO | WO 01/56428 | 8/2001 |
| WO | WO 2009/087195 | 7/2009 |

* cited by examiner

Fig. 2a
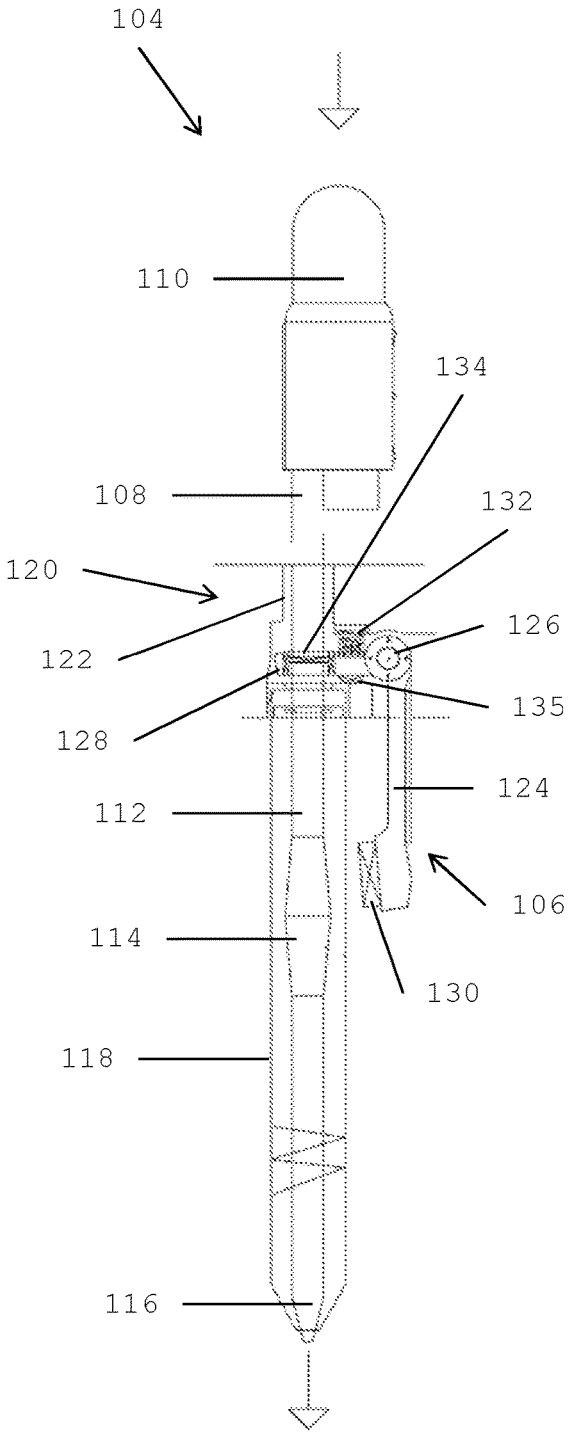
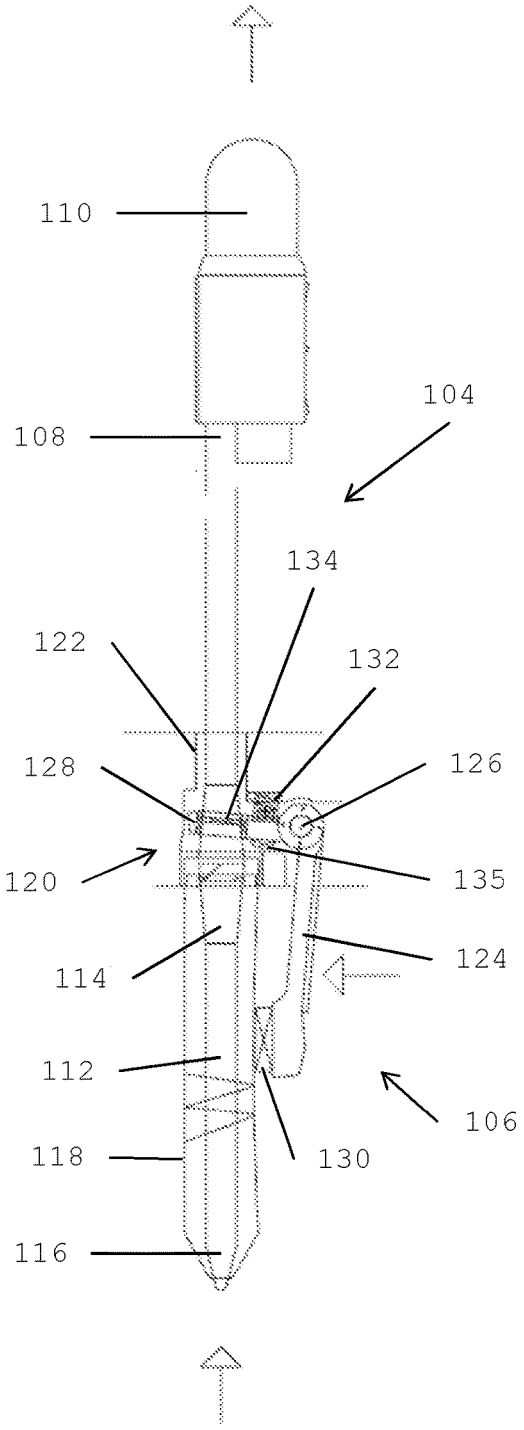
Fig. 2b

Fig. 9
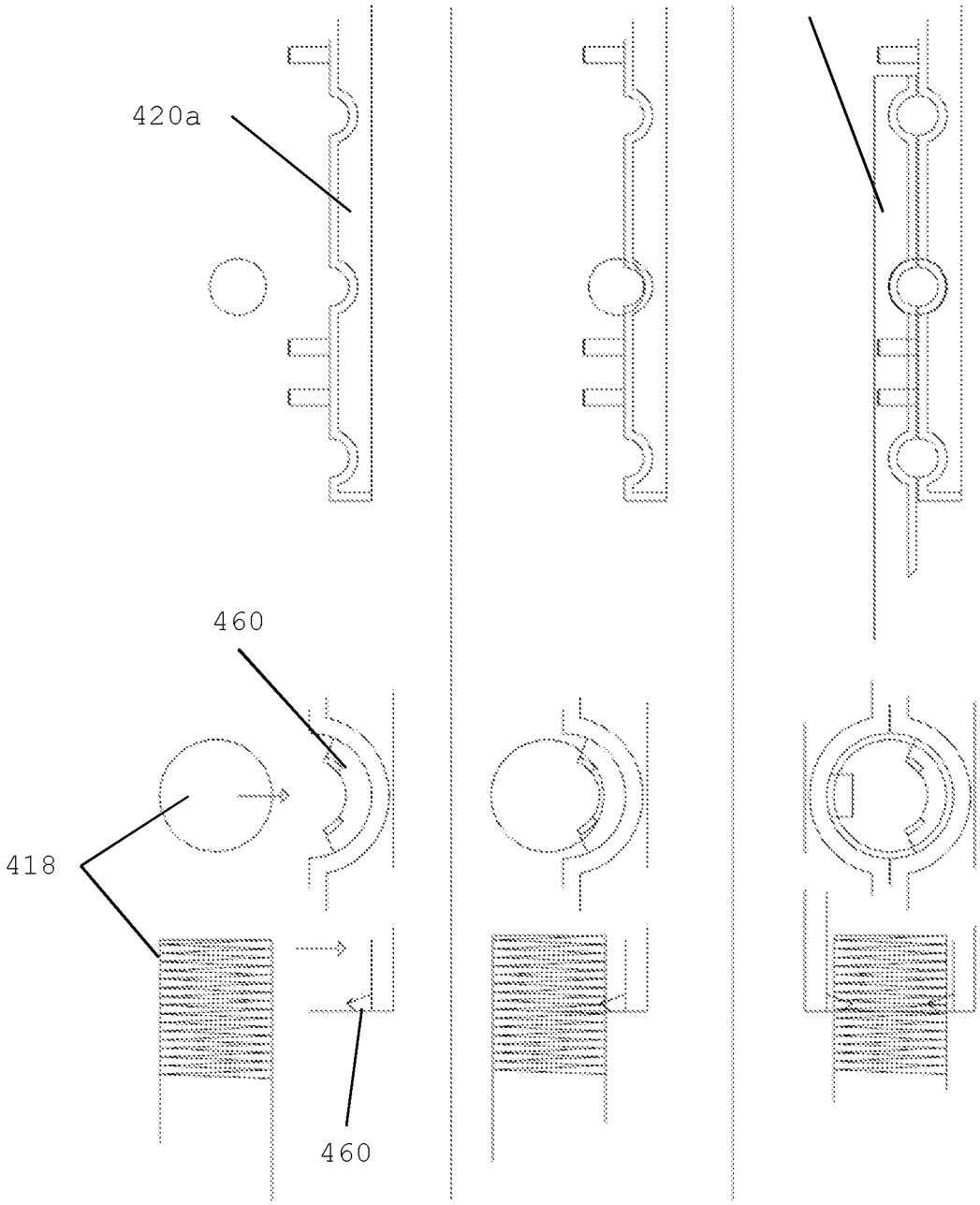
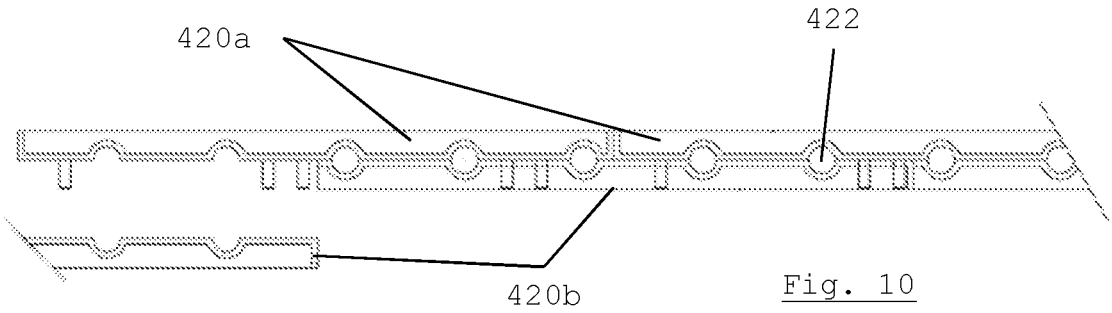
Fig. 10

Fig. 11
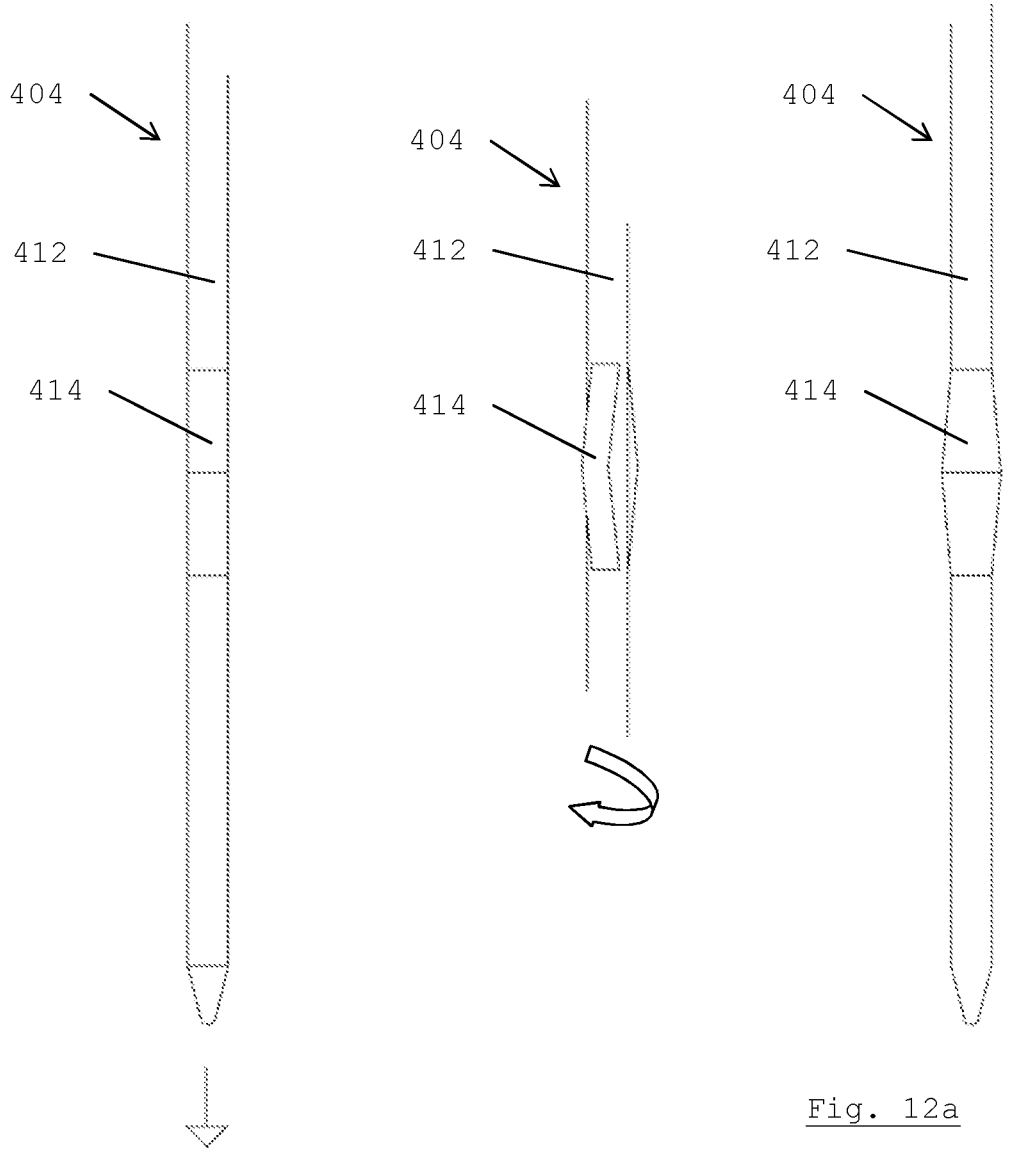
Fig. 12a
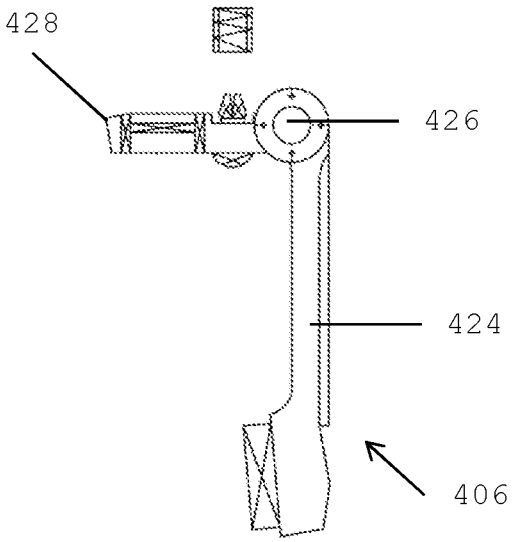
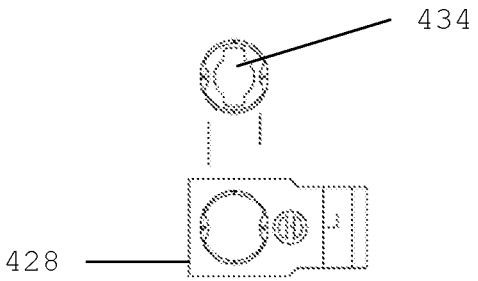
Fig. 12b

BEDS

FIELD OF THE INVENTION

The present invention concerns improvements to beds. In particular, although not exclusively, aspects of this invention concern improvements to beds which comprise a support surface defined by a plurality of individual support members. Other aspects of this invention concern improvements to bed frames. The invention also concerns methods of manufacturing such a bed.

BACKGROUND OF THE INVENTION

The structure of a conventional bed is well known. Typically, a mattress is provided on a bed frame. The mattress supports a user's body and attempts to conform to the shape of the user in order to increase the contact area with the user, thereby reducing the pressure on a particular part of the user's body.

A common type of mattress is a spring mattress. Spring mattresses typically comprise a fabric case housing a plurality of vertically arranged springs which deform under the weight of the user. The audible noise generated by deformation of the springs and vibration of the springs is typically low. This is due to the presence of the outer layers of the mattress which are effective at damping these vibrations. This is especially true with modern mattresses which often include several outer layers of material. Prior art mattresses also include pocket spring mattresses, in which the springs are individually encased in their own fabric pocket. Here the fabric pockets will further help to damp the vibrations in the springs.

Mattresses suffer from various disadvantages however. Dust, dirt, moisture and other undesirable foreign matter can collect and be absorbed in the mattress. Dust mites can thrive in a used mattress, giving rise to allergic reactions to certain users of the mattress. Mattresses are typically difficult to keep clean and/or difficult to clean, when dirty.

Mattresses can suffer from the "roll together" effect, whereby two people sleeping on the same bed have a tendency to roll towards each other.

The thermal properties of mattresses, and through ventilation, are often such that users complain of being too hot in bed.

There are beds of the prior art such as, for example, water beds that do not require the provision of a conventional mattress, thereby avoiding at least some of the above-mentioned disadvantages associates with such mattresses. Water beds however suffer from other disadvantages. For example, water beds can leak. Also water beds suffer from the undesirable effects of "ballooning", that is, when one region of the bed is depressed another region rises owing to the volume of water being substantially constant and "wave motion", where the surface of the bed can continue to move owing to wave-like motion of the water in the bed. Both ballooning and wave motion can reduce the comfort of the user or users of the bed.

The prior art also comprises beds which do not require a conventional mattress, and which do not suffer from the disadvantages often associated with water beds. An example of such a bed is described in International patent application WO00/16664. In this example, a support surface is defined by a plurality of vertically arranged support members. Unlike a mattress, which effectively surrounds the springs within the mattress with sound-insulating material such that noise associated with moving about on top of the mattress is relatively low, the internal workings of the bed described in WO00/16664 are not so well sound-insulated. Whilst the absence of such sound-insulating material around the springs and other mechanisms of the bed of WO00/16664 has significant advantages (it provides better ventilation and less of a hospitable environment of dust, dirt, moisture, dust mites and the like) it does risk an increase in the level of noise caused by the user(s) moving about on top of the bed.

Some beds are constructed with bed frames having sides which extend upwardly and around the body support surface. In the case of a bed having a mattress, the sides can prevent the mattress from moving in relation to the frame. In the case of a bed whose support surface is defined by a plurality of vertically arranged support members (such as in WO00/16664), the sides can conceal and protect the inner workings of the bed. Additionally, the sides can prevent a user from rolling out of the bed.

A problem with such sides to beds is that they can make it more difficult for a user to get in and out of such a bed. It is normal for a user to get out of a bed by sitting on the edge of the support surface, swinging their legs over the side of the bed, placing their feet on the floor, and standing up. If a user is trying to get out of a bed with sides in such a manner, the user could find themselves in a position in which they are sitting with their hips being disposed lower than the back of their knees (which may be resting on the side of the bed). In this position it can be more challenging to get out of bed as the user must essentially lift their torso over the sides of the bed.

The present invention seeks to mitigate one or more of the above-mentioned problems/disadvantages. Alternatively or additionally, the present invention seeks to provide an improved bed.

SUMMARY OF THE INVENTION

The present invention provides, according to a first aspect, a bed comprising a support surface defined by a plurality of support members, wherein: each support member is mounted for movement in a direction substantially normal to the support surface; at least some of the support members are resiliently urged towards an unloaded position by means of a spring; and a damping system is provided for damping vibrations of the spring.

The support surface of the bed may be the upper surface of the bed which supports a user's weight. The bed may comprise a frame. The frame may define the limits of the support surface. A user will typically rest upon the support surface. Of course, a user may rest on the support surface indirectly, for example, via a sheet and/or mattress topper.

The support surface could be divided up into a plurality of independently moving surface elements. Each support member may define a surface element. The support surface may thereby be defined by a plurality of adjacent support members. Preferably the bed may comprise more than 250 support members, preferably more than 500 support members, more preferably more than 1000 support members. The support members may be arranged in an array within the limits of the support surface defined by the frame.

The support members may be elongate. The support members may be substantially rigid. The support members may comprise a first end which defines a surface element. The first end may be provided with an end cap. The end cap may define a surface element. The support members may comprise a shaft, the shaft having an axis. The axis of the shaft may be substantially normal to the support surface. The support members may be mounted such that, when the support member is loaded, it moves in a direction substantially parallel to its axis. Each support member may be arranged for movement independent of adjacent support members. The support members may move relative to the frame.

The bed may comprise a support structure. The support structure may be mounted to the frame of the bed. The support structure may comprise one or more guide members for guiding the movement of the support members. The guide members may each guide at least one of the support members, preferably a multiplicity of support members is guided by one of the guide members. The arrangement of the guide members may define the arrangement of the support members.

The guide members may prevent, or substantially restrict, movement of the support members in a direction parallel to the support surface. The guide members may allow, or in other words guide, movement of the support members in a direction normal to the support surface.

The guide members may each comprise an aperture for receiving one of the support members. The guide members may be elongate. The guide members may extend substantially between one side of the bed and the other side of the bed, for example, the guide members may run the width of the bed. The guide members may each comprise a plurality of apertures.

The guide members may each comprise a first part and a second part. The first part and the second part may each comprise a recess which defines the aperture when the first part and the second part are brought together. The aperture may not be uniform. The aperture may be a slot. The aperture may have a size and shape corresponding to that of the support member so that the support member may move freely through the aperture in a direction normal to the support surface, yet the aperture may restrict the movement of the support member in directions parallel to the support surface.

Not all support members may have their movement guided by the guide members. At least some of the support members may be guided by other means. The support members may be mounted to adjacent support members and be guided by way of their mounting. The support members may be slidably mounted to adjacent support members. The support members may comprise laterally extending attachment means for mounting to adjacent support members.

At least some of the support members may be sprung by means of a spring. The sprung support members may each have one of the springs associated with them. The springs may be tension springs. The springs may be compression springs. Not all support members may be sprung support members. The support members guided by the guide members may be sprung support members.

The springs may be mounted to the guide members. Each of the springs may be retained in one of the apertures of the guide members. The apertures may each comprise a formation for retaining the spring. For example, the apertures may each comprise a projection for engaging between the coils of the spring. The engagement of the projection between two adjacent coils of the spring may retain an end of the spring in the guide member. The projection may be substantially annular and extend a majority of the way around the aperture. In the case where the guide members comprises a first part and a second part which define an aperture, the projection may be provided on one or both of the first part and the second part of the aperture.

The springs may comprise a tapered end into which an end of one of the support members is received. The support member may be retained by the tapered end of the spring without the need for the support member to be affixed to the spring.

Each support member may have an unloaded position. In the unloaded position, the support member may not be subject to loads due to the weight of an object placed directly on the support member. In the unloaded position, the support member may not be subject to loads due to the movement of adjacent support members. The sprung support members may be urged towards the unloaded position by their associated spring. The spring may still be under tension or compression when the support member is in the unloaded position.

Correspondingly, each support member may have one or more loaded positions. In the one or more loaded positions, the support member may be subject to loads due to the weight of an object placed directly on the support member. In the one or more loaded positions, the support member may be subject to loads due to the movement of one or more adjacent support members. In the one or more loaded positions, the sprung support members may be urged towards the unloaded position by their associated spring. In the one or more loaded positions, the support members which are not sprung may be urged towards the unloaded position by adjacent support members.

At least some of the springs may be provided with a damping system. Preferably, a majority of the springs may be provided with a damping system. A plurality of damping systems may be provided. The damping systems may be damping mechanisms. A single spring may be associated with a single damping system. In other words, one damping system may be provided per spring.

The damping system may damp its associated spring when the associated support member is in the unloaded position. The damping system may not damp its associated spring when the associated support member is in the one or more loaded positions.

The damping system may have an engaged state, in which the damping system is engaged with its associated spring and the spring is damped. The damping system may have a disengaged state, in which the damping system is disengaged with its associated spring and the spring is not damped. There may be a threshold load, corresponding to a threshold position of the associated support member, at which the damping system transitions from the engaged state to the disengaged state. For example, the damping system may be in an engaged state when the associated support member is in an unloaded position; the support member may be loaded and correspondingly travel a first distance to a threshold position; the damping system may disengage with the associated spring; and the support member may continue to travel a second distance to a position at which the forces on it are in equilibrium. For example, the damping system may be in an engaged state when its associated support member is within 15 mm of an unloaded position, optionally within 10 mm of an unloaded position, optionally within 5 mm of an unloaded position.

It may be advantageous to damp the springs when they have returned, or are returning, to their unloaded positions. This is because at least some of the potential energy and translational kinetic energy associated with the loaded springs dissipates as vibrational kinetic energy when the springs unload to their unloaded positions. These vibrations can manifest as audible noise.

The damping system may disengage with its associated springs under the force of gravity. Additionally or alternatively, the damping system may be resiliently urged towards a disengaged state. For example, the damping system may comprise a second spring which is arranged to urge the damping system towards a disengaged state. Each damping system may be associated with a second spring arranged to urge the damping system towards a disengaged state. In another example, the compression or extension of a resiliently deformable plastic, such as TPE, may be used to urge the damping system towards a disengaged state.

In the context of certain embodiments of the invention, a bed having a damping system for damping vibrations in or on its springs has the advantage that less audible noise is produced when the support surface is unloaded and loaded, or when the load is changed on a particular support member. It is noted that no vibrations necessarily need to be present on the spring for the damping system to operate.

The damping system may comprise a damping arm. The damping arm may be arranged to engage with an associated spring. A single damping arm may be provided to engage with a single spring. In other words, there may be one damping arm per spring. The damping arm may damp any vibrations in the associated spring when it engages with the spring. The damping arm may provide no damping when it is not engaged with the spring. The damping arm may engage with the spring by coming into contact with the spring.

The damping arm may have a particular portion which is arranged to engage with the spring. The portion arranged to engage with the spring may have an engagement surface comprising damping material. The damping material may convert the vibrational energy of the spring into heat or other energy, preferably not noise energy. The damping material may be resilient material. The damping material may, for example, include: a polymeric material, soft plastic, rubber, neoprene, foam, felt or other suitable material. A specific damping material may not necessarily be provided on the damping arm, but it is preferable.

The damping arm may be pivotally mounted to the bed. The arm may move as to engage and disengage with the associated spring by pivoting around a pivot point. The pivot point of the damping arm may be provided on one of the guide members. The damping arm may be urged away from the associated spring by means of the second spring. The damping arm may be urged away from the associated spring by means of the resiliently deformable plastic. The resiliently deformable plastic may be overmoulded onto the damping system.

The support members may each have a formation. The damping system may have a corresponding formation arranged to engage with the formation.

The formation may comprise, for example: a slot, an aperture, a recess, and/or a laterally extending protrusion. The support member may comprise a laterally extending protrusion in the form of a projection or a rim extending beyond the average width of the support member. The formation may be on the shaft of the support member. The formation may not extend around the entire circumference of the support member.

The corresponding formation may comprise, for example: a slot, an aperture, a recess and/or a laterally extending protrusion. The damping system may comprise an aperture whose radius is larger than the average width of the support member but smaller than the width of the support member at the formation, with which the corresponding formation engages.

The formation and corresponding formation may be configured to engage when the support member is in a particular position relative to the damping system. The formation and corresponding formation may be configured to engage when the support member is subject to a particular load. For example, the formation and corresponding formation may engage when the support member is in the unloaded position, the one or more loaded positions or at a threshold position. The support member and the damping system may be so arranged that engagement of the formation and the corresponding formation effects engagement of the damping system with the spring.

The damping system may comprise a damping system engagement arm. The damping system engagement arm may comprise a member comprising the corresponding formation. The damping system engagement arm may be mechanically connected to the damping arm. By way of the formation engaging with the corresponding formation when the support member is in a particular position, the damping arm may be engaged with the spring.

The engagement of the formation and corresponding formation may limit the movement of the support member in the vertical direction. The formation and corresponding formation may act as a stop preventing the support member from being pulled out of the bed. The positions of the formation in relation to the corresponding formation may therefore define the unloaded position of the support member.

At least a multiplicity of the support members may be so arranged that movement of any one of those support members in a direction substantially normal to the support surface, and beyond a threshold distance relative to an adjacent support member, causes movement in substantially the same direction of said adjacent support member. There may be substantially no movement of said adjacent support member caused by the movement of said any one of those support members when the distance of relative movement is below the threshold distance.

At least some of the support members may be provided with one or more laterally extending pusher members. The pusher members may comprise an engagement surface arranged to engage with adjacent support members. Particularly, the pusher members may comprise an engagement surface arranged to engage with the one or more pusher members of adjacent support members.

A plurality of the support members may be arranged such that movement of a first support member, having a laterally extending pusher member, in a direction substantially normal to the support surface and beyond a threshold distance relative to a second support member, the second support member being adjacent to said first support member, causes said laterally extending pusher member of said first support member to push said adjacent support member in substantially the same direction as said first support member.

According to a second aspect of the invention there is also provided a bed comprising a support surface defined by a plurality of support members, wherein: each support member is mounted for movement in a direction substantially normal to the support surface; and at least some of the support members are provided with a laterally extending pusher member, wherein the pusher member comprises an engagement surface arranged to engage with adjacent support members, the engagement surface comprising damping material.

Provision of damping material may reduce audible noise associated with interaction of the adjacent support members. Particularly, the audible noise associated with the interaction of pusher members may be reduced.

The damping material of the engagement surface may, for example, include: a polymeric material, soft plastic, rubber, neoprene, foam, felt or other suitable material.

The damping material may be bonded to the pusher member. For example, an adhesive may be used to bond the damping material to the pusher member.

The damping material may be a polymeric material. The damping material may be overmoulded onto the pusher member. This may be by an injection moulding process.

Additionally or alternatively, the damping material may be mechanically attached to the pusher member, for example by an interference fit or a catch.

The entire engagement surface may consist of the damping material. Alternatively, only a portion of the engagement surface may comprise the damping material. The pusher member may, in whole or in part, comprise the damping material. The pusher member may comprise an outer layer comprising the damping material and an inner layer comprising a material with significantly lower damping properties.

The first and second aspects share the feature that the bed comprises a support surface defined by a plurality of support members being mounted for movement in a direction substantially normal to the support surface. Features of an example of such a bed, particularly the support members and the interrelationship thereof, are described and claimed in International patent application publication number WO00/16664 entitled "Body Support Apparatus". The contents of that application are fully incorporated herein by reference. The claims of the present application may incorporate any of the features disclosed in that patent application. In particular, the claims of the present application may be amended to include features relating to the structure of the support members, the means by which the support members may cause movement of adjacent support members when they move beyond a threshold distance, and the support structure which supports and guides the support members.

Embodiments of the first and second aspects of the present invention are able to provide the advantages of a bed of the type provided in WO00/16664, and by means of a bed that exhibits less noise during use. The springs of the bed of WO00/16664 are, in comparison to a conventional mattress, not in an environment where their vibrations are readily damped. Unlike in mattresses, the springs are not surrounded by soft material which can absorb the vibrations formed in the spring when the spring is deformed. The arrangement of the springs also makes them liable to vibrate in a transverse direction as well as in a longitudinal direction. These vibrations might manifest as audible noise when the springs and support members are moved. Another potential source of noise, which is particular to the bed described in WO00/16664, is that generated by the interaction of adjacent support members when the support surface is loaded and unloaded.

According to a third aspect of the invention there is also provided a method of manufacturing a bed comprising a support surface defined by a plurality of support members. The method may comprise the following steps. The method may comprise providing a support member comprising a shaft. The shaft may have a laterally extending protrusion. The method may comprise providing a receiving element having an aperture configured to receive the shaft and the protrusion when the support member is in a first orientation relative to the receiving element. The method may comprise orienting the support member to the first orientation relative to the receiving element. The method may comprise inserting the shaft and protrusion into the aperture. The method may comprise rotating the support member to a second orientation relative to the receiving element, in which the shaft and protrusion cannot be freely removed from the aperture. The method may thus provide a convenient way of assembling a bed—with the support member being in the first orientation relative to the receiving element, whilst allowing a function during use—with the support member being in the second orientation relative to the receiving element—which requires, for example, positive engagement of the protrusion with the receiving element, rather than allowing free passage through the aperture.

The receiving element may be a guide member, or part thereof. The receiving element may be a damping system, or part thereof. The method may include the step of providing a spring for receiving an end of the support member. The spring may be mounted to or received by the guide member. The spring may comprise a tapered end into which the support member is received.

The method may comprise providing a support member comprising a laterally extending pusher member. The pusher member may comprise an engagement surface arranged to engage with adjacent support members. The method may comprise overmoulding a damping material onto said engagement surface.

The method may comprise providing a first part of a guide member for guiding a support member. The first part may define a first side of an aperture for receiving a support member. The first side of the aperture may comprise a first projection. The method may comprise engaging a spring with the first projection such that the first projection is engaged between two adjacent coils of the spring. The method may comprise providing a second part of the guide member onto the first part of the guide member, the second part defining a second side of the aperture. The second side of the aperture may additionally comprise a second projection for engaging between two adjacent coils of the spring.

The first part of the guide member may comprise dowels or pins. The second part of the guide member may comprise holes for receiving the dowels or pins when the first part and second part are brought together. The dowels or pins and the holes may thereby align the first part and the second part.

The method may comprise providing a damping system. The method may comprise the step of mounting the damping system to the guide member. The first part and the second part of the guide member may comprise corresponding cavities for receiving at least a part of the damping system. The damping system may combine a bore about which the system is arranged to pivot. The method may comprise the step of slotting the bore over a third projection in the first part and/or second part of the guide member. The third projection may be the dowel. The damping system may thereby pivot about the projection which acts as an axle.

The method may comprise manufacturing one or more of the above mentioned components of the bed (i.e. the support members, the damping system, the guide member, etc.). The components may be made of plastic. The components may be manufactured by injection moulding. The components may be made of metal. The components may be manufactured by fabricating metal, for example, by casting metal. The components may be one piece or may themselves be assembled from various parts. The skilled person would appreciate that other material and manufacturing processes exist which would be suitable for manufacturing such components.

The present invention provides, according to a fourth aspect, a bed frame comprising a side for bordering a body support surface of a bed, wherein: the side comprises a plurality of side elements mounted for movement in a direction substantially normal to the body support surface; and the side elements are resiliently urged towards an unloaded position.

An advantage of certain embodiments of the present invention, particularly an advantage of embodiments according to the fourth aspect now described, is that the bed is provided with sides, and so benefits from the aforementioned advantages thereof, whilst the movement of the sides enables a user to get in and out of the bed more easily than if the sides were of fixed height.

The bed frame may be a bed frame for a conventional bed comprising a base and a mattress disposed on the base. The bed frame a may be a bed frame for a bed comprising a plurality of body support members. The bed comprising a plurality of body support members may be a bed as substantially described herein and in International application WO00/16664.

The bed frame may be arranged to border a body support surface of the bed. The body support surface may be substantially planar and be arranged parallel to the ground when in use. The body support surface may be defined by the upper surface of the mattress. The body support surface may be defined by the plurality of body support members.

The bed frame may comprise one or more sides, any one or more of which may comprise movable side elements. The sides may be disposed along the periphery of the body support surface. The sides may retain the body support surface or components thereof. For example, the bed frame may be rectangular in shape and thus have four sides (two opposing longitudinal sides, a side corresponding to a foot of the bed and a side corresponding to a head of the bed). Any combination of these four sides may comprise movable side elements.

The movable side elements may be disposed along a substantially straight line (for example when viewed in plan).

The side may comprise more than 10 moveable side elements, preferably more than 20 moveable side elements, and preferably more than 30 moveable side elements.

Each movable side element may have a length, the length being measured in a direction along the length of the side of the bed with which the side element is associated. In the case where the body support surface is defined by a plurality of body support members, it may be that the length of each side element is longer (preferably more than twice as long) than the maximum dimension lengthwise or widthwise (along the length or width of the bed, that is) of the median size of support member of the bed.

The length of each side element may be between 20 mm and 500 mm, for example, the length of the side may be about 50 mm. The length of each side element may be between 40 mm and 400 mm, 100 mm and 300 mm, or 150 mm and 200 mm.

The moveable side elements may comprise an upper portion which defines the upper edge of the side of the bed. The upper portion may be shaped to provide an aesthetically pleasing shape and/or comfortable shape when the side of the bed is sat on.

The movable side elements may comprise a lower portion. The lower portion may be elongate. The lower portion may provide a mounting which enables the movable side element to move.

The bed frame may have a side support structure. The moveable side elements may be movably mounted to the side support structure. The movable side elements may be slidably mounted to the side support structure.

The skilled person would be familiar with various ways to provide a slidable mounting. By way of example, the movable side element may comprise a rod and the support structure may comprise a corresponding slot through which the rod slides, or vice versa. A possible advantage of this arrangement is that the moveable side element may be restricted to movement along the axis of the rod, which can be disposed in the vertical direction. In another example, the movable side element and support structure may each be provided with runners. In another example, the movable side element may be provided with a groove and the support structure may be provided with a corresponding member for sliding within the groove, or vice versa.

The side support structure may be a substantially rigid structure which substantially spans the length of a side.

Alternatively, or additionally, the side support structure may comprise a plurality of base elements. Each movable side element may be mounted to one base element. The movable side elements and base elements may thereby define a side portion, a plurality of which could be arranged to define a side in a substantially modular manner. The side portions may be linked at the base element. The base elements may be linked, for example, by being bolted together, permanently bonded during manufacture, and/or removably attached by way of corresponding formations.

The movable side element may have an unloaded position. In the unloaded position, the movable side element may not be subject to external loads due to the weight of objects placed on movable side element and/or subject to loads from adjacent movable side elements.

The moveable side element may be resiliently urged towards the unloaded position. The moveable side element may be resiliently urged towards the unloaded position by means of a spring, for example a tension spring or a compression spring. In the unloaded position the spring may be under tension or compression respectively.

The side support structure may have a stop to limit the movement of the movable side element. The moveable side element may be urged towards the stop, the arrangement of which defines the unloaded position.

In the case where the slidable mounting comprises a slot and a rod extending therethrough, a compression spring or a tension spring may be disposed on the rod such that the rod extends through the spring. This has a possible advantage of preventing the spring from bending (or at least significantly reducing the risk of the spring bending too much).

In example arrangements, the side support structure may comprise a slot, the movable side element may comprise a rod, and a spring may be provided through which the rod is received. One end of the spring may be connected near the slot and another end connected near an end of the rod. As the side support structure and the movable side element are urged towards each other the spring may extend or compress (depending on the type of spring used) thereby urging the movable side element back toward the unloaded position.

A movable side element comprising a slidable mounting and compression spring arrangement may be provided without the need for a rod. Particularly the rod may not be necessary in the case where the spring has sufficient width and/or stiffness to avoid bending during normal use.

The movable side element may be movable independently of adjacent movable side elements. Alternatively, the movement of the movable side element may have interdependence on the movement of adjacent movable side elements.

The movable side elements may be so arranged that movement of a first movable side elements in a direction substantially normal to the support surface, and beyond a threshold distance relative to a second adjacent movable side element, causes movement of said second adjacent movable side element in substantially the same direction as the first movable side element.

There may be substantially no movement of said second adjacent movable side element caused by the movement of said first movable side element when the distance of relative movement is below the threshold distance.

A plurality of adjacent movable side elements may be configured to have the above interdependence. By means of this interdependence, successive adjacent movable side elements may move in a cascade like manner in response to movement of any one of the movable side elements. The lateral extent of this cascade, i.e. the number of movable side elements being moved in substantially the same direction as the first movable side element, may be dependent on the number of 'threshold distances' the first movable side element has traveled. A maximum angle of inclination of the upper edge of the side may be predetermined by selecting an appropriate threshold distance.

The means by which the movable side elements interact may be substantially similar to the means by which the support members interact according to the preceding aspects of the invention. At least some of the movable side elements may comprise one or more laterally extending pusher members. After the first movable side element has traveled to and beyond the threshold distance its pusher member may push the second adjacent movable side element in substantially the same direction.

The pusher member of the movable side element may push against a pusher member of an adjacent movable side element.

The movable side element may be provided with a vertically extending groove. The pusher member of a first movable side element may be received within the groove of a second movable side element. The length of the groove may correspond with the threshold distance. The pusher member may be able to slide within the groove between a top of the groove and a bottom of the groove. When the first movable side element moves such that the pusher member interacts with the top of the groove or the bottom of the groove, the second movable side element may be urged in the direction of the first movable side element. Similarly, when the second movable side element moves such that the top or bottom of the groove interacts with the pusher member, the first movable side element may be urged in the direction of the second movable side element.

An alternative way of providing interdependence between adjacent first and second movable side members may be by attaching the movable side elements together with a length of rope. The rope may be so arranged that when the first movable side element moves beyond the threshold distance relative to the second movable side element the rope becomes taut and pulls the second movable side element in substantially the same direction as the first support member. Similarly, rigid puller members may be provided which work in a similar manner.

Movement of the support surface may not affect the movement of the side members. Alternatively, the movement of the support surface and the movement of the side members may be interdependent. In the case of a bed whose support surface is defined by a plurality of support members, the movable side elements may be arranged to interact with the support members.

The support members adjacent to the movable side elements may be arranged so that movement of a first movable side elements in a direction substantially normal to the support surface, and beyond a threshold distance relative to one or more adjacent support members, causes movement of said support members in substantially the same direction as the first movable side element.

The movable side elements may have formations which are configured to interact with adjacent support members. For example, the movable side elements may have formations which are configured to interact with adjacent support member's pusher members. Alternatively, the movable side elements may be fixedly attached to one or more adjacent support members. The movement of the movable side elements may therefore have an influence on the movement of the support members via the fixedly attached support member.

The support structure may include a height adjustable support arranged to receiving a mattress. The height adjustable support may extend horizontally from the support structure. The height adjustable support may enable the relative height of the mattresses body support surface to be changed. The bed frame may thereby accommodate various mattress thicknesses and give the user the ability to alter the relative height of the sides of the bed in relation to the mattress.

According to a fifth aspect of the invention there is also provided a method of manufacturing a bed frame comprising a side defined by a plurality of movable side elements. The method may comprise a step of providing a side support structure. The method may comprise a step of mounting the movable side elements onto the side support structure.

The side may comprise a plurality of side portions. The side portions may comprise a movable side element and a base element. The side support structure may comprise a plurality of base elements. The method may comprise a step of linking a plurality of side portions to form a side. The method may comprise a step of linking a plurality of a base elements and/or linking a plurality of movable side elements.

It will of course be appreciated that features described in relation to one aspect of the present invention may be incorporated into other aspects of the present invention. For example, the features described in relation to the bed of the first aspect of the present invention may be incorporated into the bed of the second aspect of the present invention and vice versa. Additionally, the method of the invention may incorporate any of the features described with reference to the apparatus of the invention and vice versa.

DESCRIPTION OF THE DRAWINGS

Embodiments of the present invention will now be described by way of example only with reference to the accompanying schematic drawings of which:

FIG. 2*a* shows a side view of a support member and damping system, according to a first embodiment of the invention, in a loaded position;

FIG. 2*b* shows a side view of a support member and damping system, according to a first embodiment of the invention, in an unloaded position;

FIG. 9 shows a sequential plan view of a spring being inserted into a guide member according to the third embodiment of the invention;

FIG. 10 shows a plan view of a guide member according to the third embodiment of the invention;

FIG. 11 shows a sequential side view of a support member being orientated with respect to the damping system according to the third embodiment of the invention;

FIGS. 12*a* and 12*b* show a side view and plan view, respectively, of a damping system according to the third embodiment of the invention;

DETAILED DESCRIPTION

Figure 1:
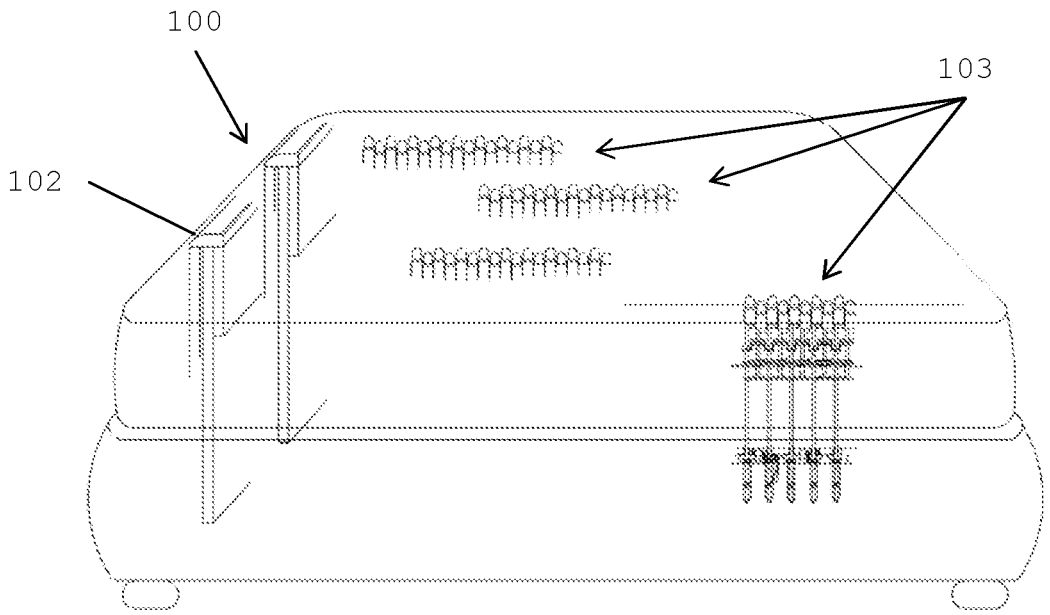
FIG. 1 shows a perspective view of a bed according to a first embodiment of the invention.

FIG. 1 shows a first embodiment of the invention, comprising a bed 100 having a frame 102, which extends around the perimeter of the bed 100. Within the boundary of the frame 102, there are provided an arrangement of a multiplicity of vertically extending support members 103. The support members 103 are arranged in rows which substantially fill the area defined by the frame 102. The, generally horizontal, upper surface of the bed, which acts as the support surface in use, is defined by the upper ends of the support members 103. For clarity in FIG. 1, the frame 102 is only shown in part and only a small proportion of incomplete rows of support members 103 are shown. Each support member 103 is mounted for movement in a vertical direction (which is thus perpendicular to the horizontal support surface). Some support members are in the form of sprung support members 104 and some are in the form of unsprung support members.

FIGS. 2*a* and 2*b* show a sprung support member 104 and damping system 106 according to the first embodiment. When a user interacts with the support surface of the bed in a way which changes the loading on individual support members, one or more support members may rapidly move to the unloaded position. Any consequent vibration that would otherwise be caused is actively damped by means of the damping system 106. The damping system 106 thus has a disengaged state when the sprung support member is in a loaded position and has an engaged state when the sprung support member is in its unloaded position. Damping of the vibration of the spring reduces noise that might otherwise be louder.

As can be seen in FIGS. 2*a* and 2*b*, the sprung support member 104 comprises: a first end 108 having a dome shaped end cap 110 defining an element of the support surface, a shaft 112, a formation in the form of a laterally extending protrusion 114 provided on the shaft 112, and a second end 116.

A guide member 120 is provided. The guide member 120 comprises an aperture 122 which extends vertically through the guide member 120. The shaft 112 of the sprung support member 104 is received within the aperture 122.

A tension spring 118 is mounted to the guide member 120 and extends downwardly from the aperture. One end of the spring 118 is retained by the guide member 120. The other end of the spring 118 is tapered and retains the second end 116 of the sprung support member 104.

The damping system 106 comprises a damping arm 124 which is pivotally mounted to the guide member 120 by pivot 126. The damping arm 124 has an end distal from the pivot 126 which comprises an engagement surface for engaging with the spring 118. The engagement surface is provided with damping material 130 for damping vibrations in the spring 118 when it is in contact with the spring 118.

An engagement arm 128 is connected to the damping arm 124 at the pivot 126. The engagement arm 128 projects at a right angle to the damping arm 124. (The skilled person will appreciate that in other embodiments the engagement arm and damping arm need not be at right angles to each other and that other suitable angles may be used.) The engagement arm 128 comprises a corresponding formation in the form of a key hole shaped slot 134, through which the shaft 112 of the sprung support member 104 extends.

FIG. 2*a* shows the sprung support member 104 in a loaded position and the damping system 106, consequently, in a disengaged state.

In the loaded position, the laterally extending protrusion 114 is disposed below the guide member 120 and does not interact with the engagement arm 128.

A second spring 132 is provided between the guide member 120 and the engagement arm 128. The second spring 132 urges the engagement arm 128 downwards, and therefore the damping arm 124 is urged out of engagement with the spring 118. In an alternative embodiment of the invention, the second spring 132 is not provided. In that embodiment, the weight of the damping arm 124 and the engagement arm 128 brings the damping arm 124 out of engagement. In another alternative embodiment of the invention, the second spring 132 is replaced by soft resiliently deformable plastic which is overmoulded onto the engagement arm. In the disengaged state, the engagement arm rests against a portion of the guide member beneath it. Damping material 135 may be provided to reduce the noise associated with the interaction between the engagement arm 128 and the guide member 120 when the damping system 106 disengages.

FIG. 2*b* shows the sprung support member 104 in an unloaded position and the damping system 106, consequently, in an engaged state.

In the unloaded position, the laterally extending protrusion 114 is in contact with, and engages, the outer edges of the slot 134 on the engagement arm 128. As seen in FIG. 2*b*, the engagement arm 128 is pushed upwards by the laterally extending protrusion 114, due to the sprung support member 104 being urged upwards by the spring 118. The engagement arm 128 and the damping arm 124 pivot around the pivot 126 thereby bringing the damping material 130 of the engagement surface into contact with the spring 118. Any vibrations present in the spring 118 will thus be damped.

In the unloaded position the spring 118 is still under tension. The laterally extending protrusion 114 is shaped such that it cannot extend through the slot 134 in the engagement arm 128. The sprung support member 104 is thereby prevented from further upward movement.

Figure 3:
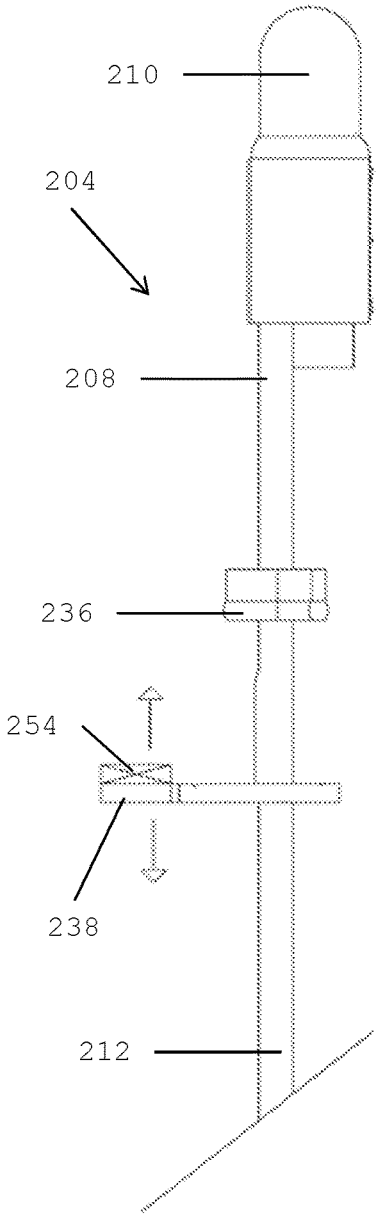
FIG. 3 shows a side view of an upper part of a sprung support member according to a second embodiment of the invention.

A second embodiment of the invention also concerns a bed including an arrangement of a multiplicity of vertically extending support members, some of which are sprung and some of which are unsprung. FIGS. 3 to 5 show support members according to the second embodiment of the invention. The support members are each provided with a laterally extending pusher member, such that the interaction of the pusher members of adjacent support members causes the movement of one support member to follow that of an adjacent support member, whereby the support surface of the bed is prevented from having any sharp changes in shape at a local level.

FIG. 3 shows a side view of one end of a sprung support member 204. The sprung support member 204 comprises a shaft 212, the shaft having a first end 208 on which a dome shaped end cap 210 is provided. A first laterally extending pusher member 236 and a second laterally extending pusher member 238 are provided on the shaft 212. The pusher members 236 and 238 extend in a direction which is normal to the axis of the shaft 212.

Figure 4A:
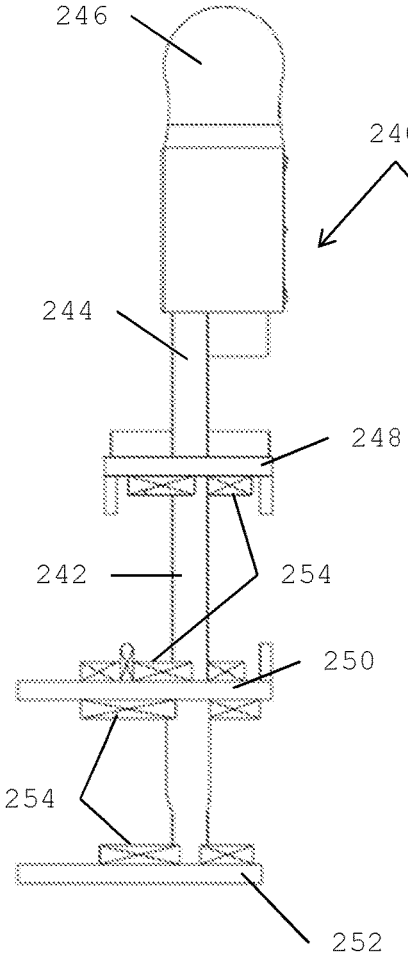
FIGS. 4*a* and 4*b* show two side views of an unsprung support member according to a second embodiment of the invention.
Figure 4B:
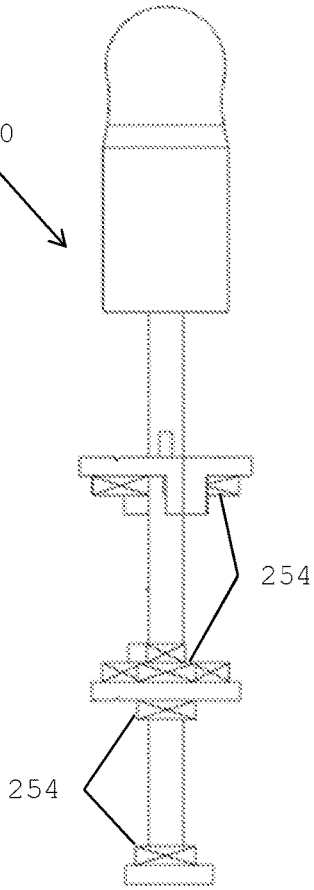

FIGS. 4*a* and 4*b* show side views of a support member which is unsprung 240. The unsprung support member 240 comprises a shaft 242, the shaft having a first end 244 onto which a dome shaped end cap 246 is provided. A first laterally extending pusher member 248, a second laterally extending pusher member 250 and a third a laterally extending pusher member 252 are provided on the shaft 242.

Figure 5A:
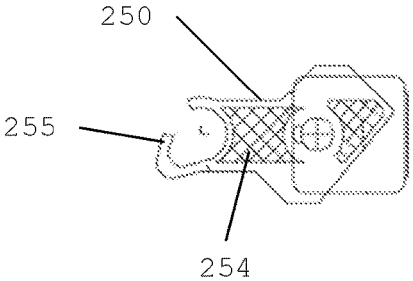
FIGS. 5*a* and 5*b* show a plan and underside view, respectively, of a pusher member according to a second embodiment of the invention.
Figure 5B:
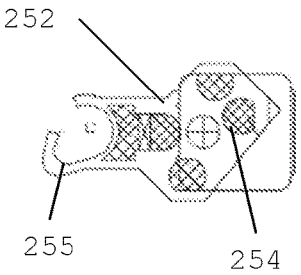

FIGS. 5*a* and 5*b* show a top view and a bottom view, respectively, of the second pusher member 250. Clips 255 enable the unsprung support members 240 to mount to adjacent support members 204.

Figure 6:
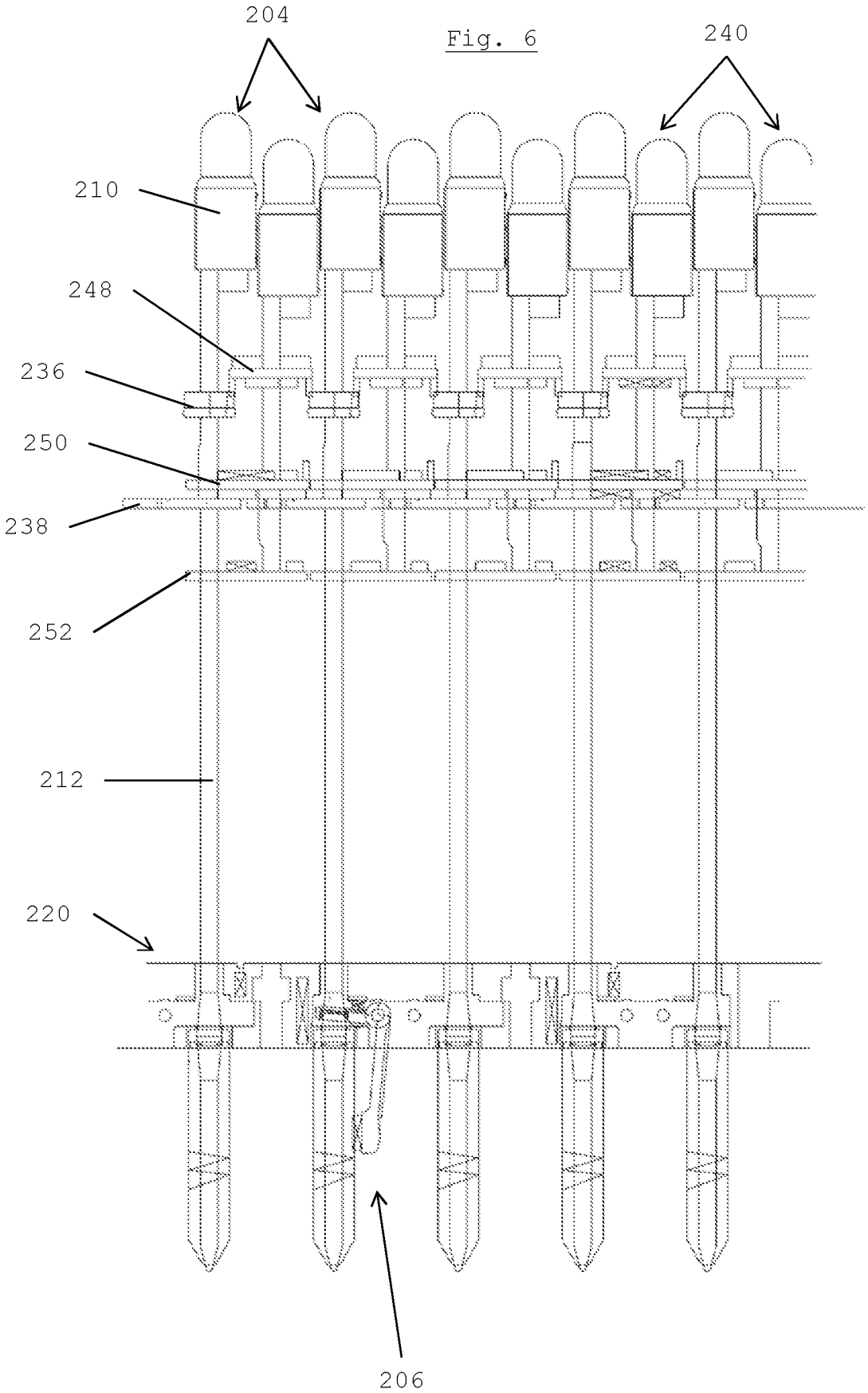
FIG. 6 shows a side view of a series of support members received by a guide member according to the second embodiment of the invention.

FIG. 6 shows, in accordance with the second embodiment of the invention, a series of sprung support members 204 received by a guide member 220. Unsprung support members 240 are disposed between the sprung support members 204 and are mounted thereto. The support members 204 and 240 are arranged linearly and are regularly spaced along the guide member. Aside from the interaction of the pusher members, the support members 204 and 240 are generally separated from each other by a small gap, but the lower cuboidal portion of the dome shaped end caps 210 may touch where their opposing surfaces overlap.

In the arrangement as shown in FIG. 6, the first pusher member 236 of the sprung support member 204 is disposed between the first and second pusher members 248 and 250 of the adjacent unsprung support member 240. Similarly, the second pusher member 238 of the sprung support member 204 is disposed between the second and third pusher members 250 and 252 of the adjacent unsprung support members 240. In the unloaded position, the first and second pusher members 248 and 250 of the unsprung support member 240 rest upon the first and second pusher members 236 and 238 of the adjacent sprung support member 204.

In this arrangement, if the sprung support member 204 is loaded, it will travel a threshold distance, corresponding to the distance between the first and second pusher members 248 and 250 of the adjacent unsprung support member 240, before its pusher members engage the upper surface of the first and second pusher members 248 and 250 of the adjacent unsprung support member 240. The adjacent unsprung support member 240 will then be urged downwardly in the direction of the sprung support member 204. This interaction of adjacent support members will continue in a cascade type manner until equilibrium is reached in response to the applied load.

According to the second embodiment, the surfaces of the pusher members which may interact with adjacent pusher members (the engagement surfaces) are provided with a damping material 254 (hatched areas in FIGS. 3 to 5*b*). In this embodiment, the damping material 254 is overmoulded onto the engagement surfaces of the pusher members in order to reduce acoustic noise that would otherwise be produced by the interaction of the pusher members.

Figure 7A:
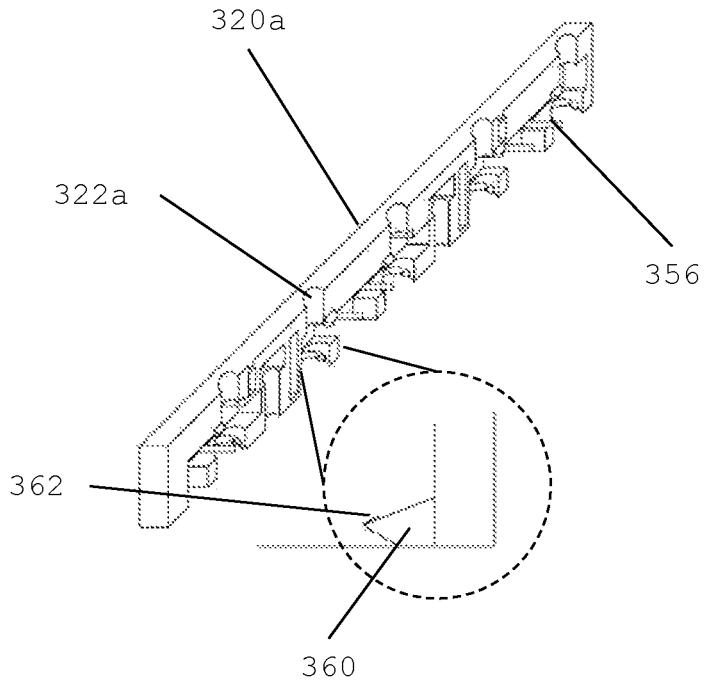
FIGS. 7*a* and 7*b* show a perspective view of a guide member for use in either the first or second embodiments.
Figure 7B:
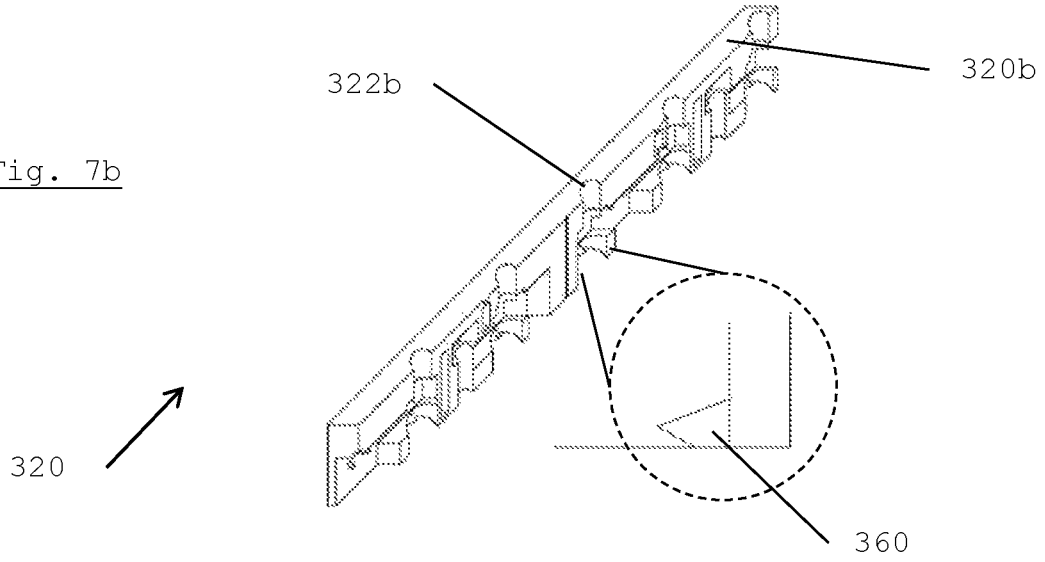
Figure 8A:
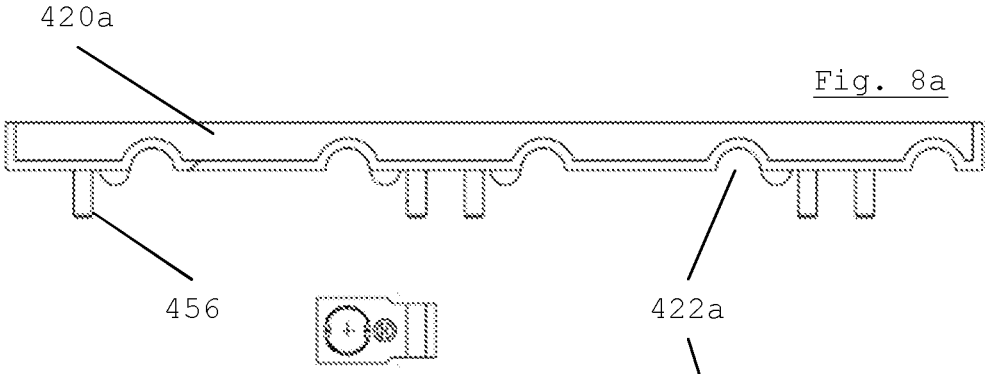
FIGS. 8*a* and 8*c* show a plan view of a first and second part, respectively, of a guide member according to a third embodiment of the invention.
Figure 8B:
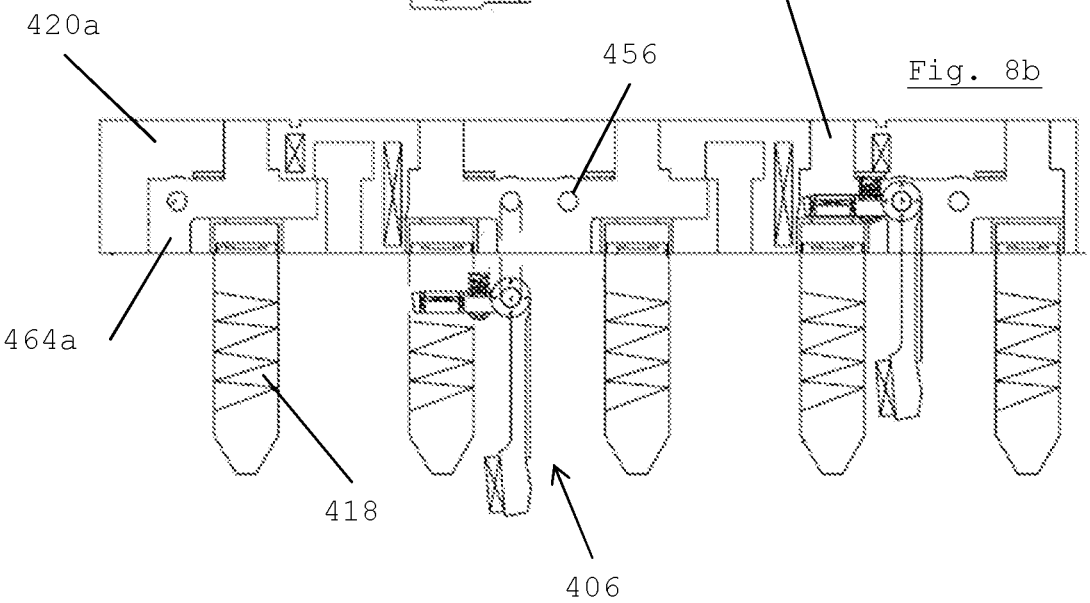
FIGS. 8*b* and 8*d* show a side view of a first and second part, respectively, of a guide member according to the third embodiment of the invention.
Figure 8C:
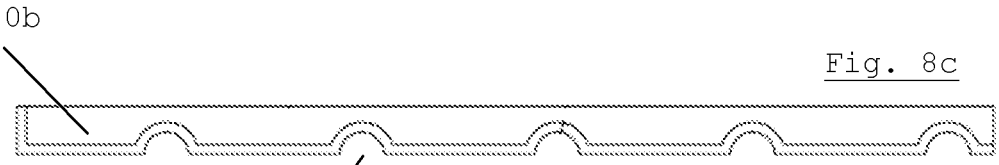
Figure 8D:
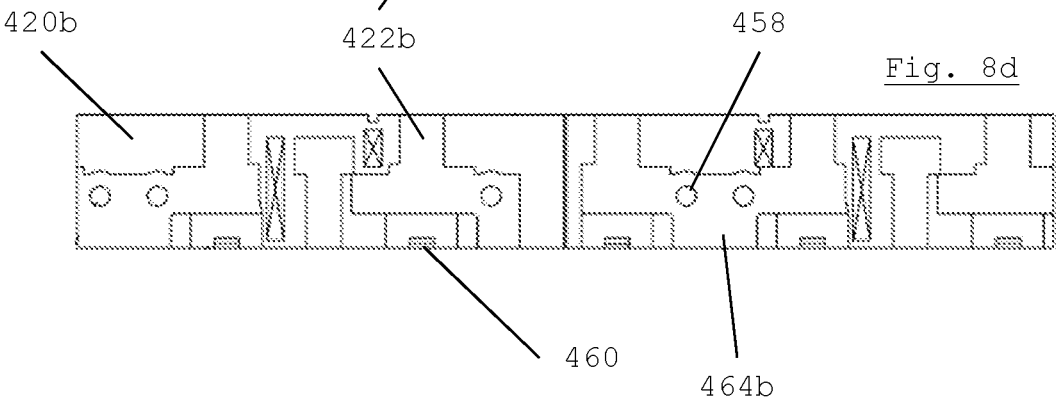

FIGS. 7*a* and 7*b* show a guide member 320 which is suitable for use as the guide member of either or both of the first and second embodiments of the invention. The guide member 320 comprises a first part 320*a* and a corresponding second part 320*b*.

The first part 320*a* and the second part 320*b* respectively comprise a recess 322*a* and a corresponding recess 322*b*. The recess 322*a* and a corresponding recess 322*b* are both arcuate in shape. When the first part 320*a* and the second part 320*b* are brought together, the recess 322*a* and the corresponding recess 322*b* define an aperture for receiving a support member.

The first part 320*a* comprises alignment pins (not shown) and the second part 320*b* comprises corresponding alignment holes (not shown) for receiving the alignment pins. When the first part 320*a* and the second part 320*b* are brought together the alignment holes receive the alignment pins thereby aligning the first part 320*a* and second part 320*b*.

The damping system 106 according to the first embodiment is mounted onto a dowel 356. The dowel 356 acts as an axle about which the damping arm 124 and engagement arm 128 pivot. The first part 320*a* and second part 320*b* comprise a cavity which accommodates at least part of the damping system 106, including the engagement arm 128.

Within the recess 322*a* a projection in the form of a spring retention shelf 360 is provided. The spring retention shelf 360 projects into the recess 322*a*. Correspondingly, within the corresponding recess 322*b* a projection in the form of a spring retention shelf 360 is also provided. The spring retention shelf 360 projects into the corresponding recess 322*b*. The spring retention shelf 360 of the recess 322*a* additionally comprises a spring catch 362 on its upper surface. According to another embodiment, the spring retention shelf 360 of the recess 322*b* may also comprise a spring catch 362 on its upper surface.

In use, when the first part 320*a* and the second part 320*b* are brought together, a spring is retained in the aperture formed by the recess 322*a* and the corresponding recess

322*b* by the spring retention shelf 360 projecting between two adjacent coils of the spring.

A method of manufacturing a bed will now be described, with reference to FIGS. 8*a* to 11, according to a third embodiment of the invention.

As a first step, the components of the bed are manufactured. Particularly, a plurality of the following components, as substantially described above, are manufactured: support members 404 comprising a shaft 412 provided with pusher members and a formation 414, guide members comprising a first part 420*a* and a second part 420*b*, and damping systems 406 comprising a damping arm 424 connected at a pivot point 426 to an engagement arm 428 comprising a corresponding formation 434. The components are manufactured by injection moulding. According to other embodiments, the components are manufactured according to other appropriate manufacturing methods.

Also by way of an injection moulding process, the pusher members are overmoulded with a soft plastic material.

To assemble the bed, a first part of the guide member 420*a* is provided. As above, the first part 420*a* comprises a plurality of regularly spaced recesses 422*a*. The recesses 422*a* comprise a spring retention shelf 460. A tension spring 418 is provided into each recess 422*a*. For each spring 418, one end of the spring 418 is pushed into the recess 422*a* such that the spring retention shelf 460 is pushed between two adjacent coils of the spring 418. A small number of coils of each spring, approximately four to five coils in this embodiment, are disposed above the retention shelf 460; the coils of the rest of the spring 418 are disposed below the retention shelf 460.

The first part 420*a* of the guide member also comprises cavities 464*a* for receiving the damping systems 406. A dowel 456 is disposed in each cavity 464*a* adjacent to each recess 422*a*. A damping system 406 is provided into each cavity 464*a*, the pivot point 426 of the damping system 406 being slotted onto the associated dowel 456. The damping system 406 is arranged such that the corresponding formation 434 of the engagement arm 428 is provided above the spring 418. The damping arm 424 is provided approximately parallel and adjacent to the spring 418.

The second part 420*b* of the guide member is then provided onto the first part 420*a* of the guide member. The second part 420*b* of the guide member comprises cavities 464*b*, holes 458 and recesses 422*b* which line up with the cavities 464*a*, dowels 456 and recesses 422*a* of the first part 420*a*. The first part 420*a* and second part 420*b* are brought together such that the recesses define an aperture 422 and the spring 418 and damping system 406 are substantially sandwiched therebetween. When constructing a guide member comprising a more than two separate parts (as in the case shown in FIG. 10), the second part 420*b* of the guide member is offset from the first part 420*a* of the guide member. In this configuration, successive first and second parts can be overlaid to construct a length of guide member corresponding to the width of the bed.

The support members 404 are subsequently inserted into the guide members. As shown in FIGS. 11, 12*a* and 12*b*, the support members must be provided at a particular orientation to the damping system. The support member 404 comprises a formation in the form of a laterally extending protrusion 414. According to this particular embodiment, the protrusion 414 is triangular in shape and extends beyond the width of the shaft 412 on two opposing sides of the shaft 412. The skilled person would appreciate that the invention is not limited to a particular shape or configuration of the formation.

The engagement arm 428 comprises a corresponding formation which takes the form of aperture in the shape of a slot 434. The shape of the slot 434 corresponds to the profile of the shaft 412 and the laterally extending protrusion 414. The shaft 412 and laterally extending protrusion 414 may only be inserted into the slot 434 when the support member 404 is at a first orientation in relation to the damping system 406.

During the method of manufacture, the support member 404 is therefore oriented at the first orientation in relation to the damping system 406. The shaft 412 of the support member 404 is then inserted into the aperture 422, and through the slot 434, to a point where the laterally extending protrusion 414 passes the slot 434.

The support member 404 is subsequently rotated 90 degrees to a second orientation in relation to the damping system 406. The shape of the slot 434 and the protrusion 414 are such that the laterally extending protrusion 414 cannot pass back through the slot 434.

Figure 13:
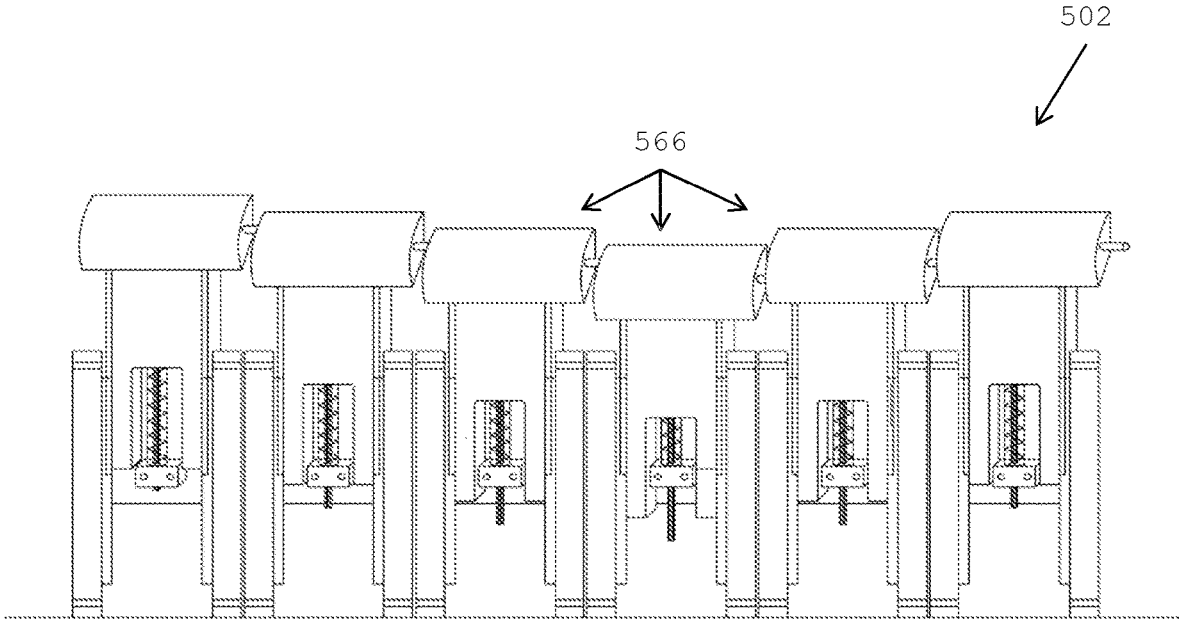
FIG. 13 shows a side view of a side of a bed according to a fourth embodiment of the invention, the side being formed by multiple side portions.

FIG. 13 shows a fourth embodiment of the invention comprising a bed frame 502. The bed frame 502 comprises a plurality side portions 566 arranged in a line to define, in use, a side of a bed.

Figure 14:
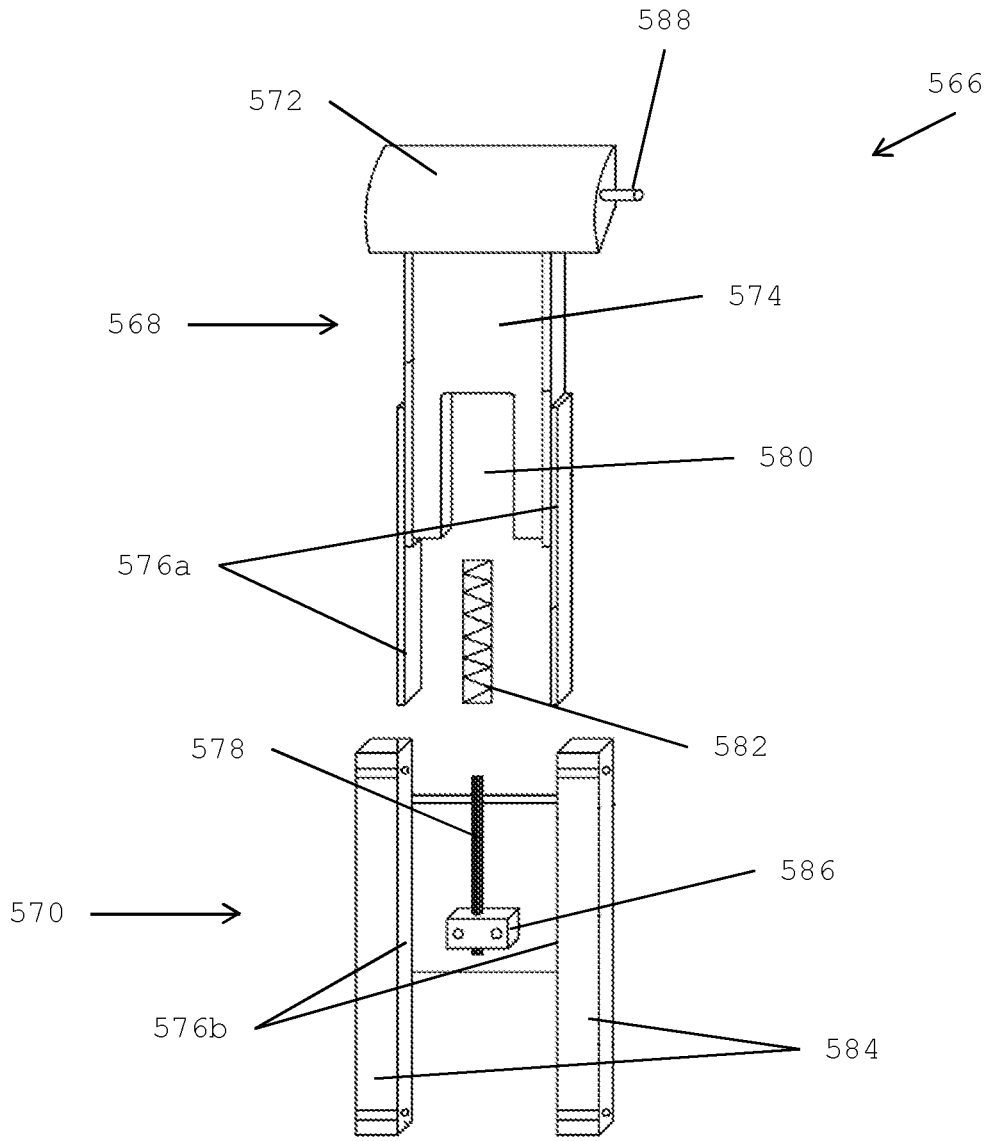
FIG. 14 shows an expanded view of one of the side portions shown in FIG. 13.

FIG. 14 shows an expanded view of a side portion 566 according to the fourth embodiment. The side portions 566 comprise a moveable side element 568 movably mounted upon a base elements 570 which rests on a floor.

The movable side element 568 comprises an upper edge portion 572. The upper edge portion 572 defines the upper edge of the side of the bed (sometimes referred to as a side rail). The upper edge portion 572 has an arcuate shape to provide comfort when sat on by the user of the bed.

The movable side element 568 comprises a lower body portion 574. The body portion 574 is in the form of a plate which extends downwardly from the upper edge portion 572. Two runners 576*a* are provided on each opposing side of the body portion 574.

The movable side element 568 also comprises a rod 578 which is mounted to the body portion 574. The body portion 574 has a cut out 580 in which the rod 578 extends. The axis of the rod 578 is vertical. A compression spring 582 is provided over the rod 578. The rod 574 gives support to the compression spring 582.

The base element 570 comprises two vertically arranged columns 584 between which a plate extends. One end of each column 584 rests on the floor. A spring support member 586 is mounted to the plate. The spring support member 586 comprises a slot through which the rod 578 may extend.

Runners 576*b* are also provided on the columns 584. In use, the moveable side element 568 is received by the base element 570, the runners 576*a* of the movable side element 568 being received by the runners 576*b* of the base element 570, and the rod 578 being received by the slot in spring support member 586.

The movable side element 568 has an unloaded position in which it is not subject to external downward loads from an object being placed upon it and it is not subject to downward loads due to interaction with adjacent movable side elements 568. In the unloaded position an end of the rod 578 protrudes only a small way through the slot in the spring support member 586.

When a load is applied to the movable side element 568 which forces it towards the floor, the spring 582 is compressed between the body portion 574 and the spring support member 586. The movable side element 568 is therefore urged towards the unloaded position by the spring 582.

The upper edge portion 572 comprises a laterally extending pusher member 588. When the side portions 566 are arranged adjacent to each other, the pusher member 588 of a first moveable side element 568 will be received by a groove in the opposing side of the upper edge portion 572 of an adjacent second movable side element 568.

In alternative embodiments the laterally extending pusher member 588 and groove are provided at other positions on the movable side member, for example, on the body portion 574.

The groove has a length and a top and a bottom. By way of interaction of the top of the groove with the pusher member 588 and/or interaction of the bottom of the groove with the pusher member 588, the adjacent moveable side elements 568 may urge each other in a vertical direction in dependence on their respective loadings. The groove has a length such that the first movable side element 568 may move a threshold distance from the unloaded position before the pusher member 588 interacts with the top of the groove and urges the second moveable side portion 568 in the same direction.

Figure 15:
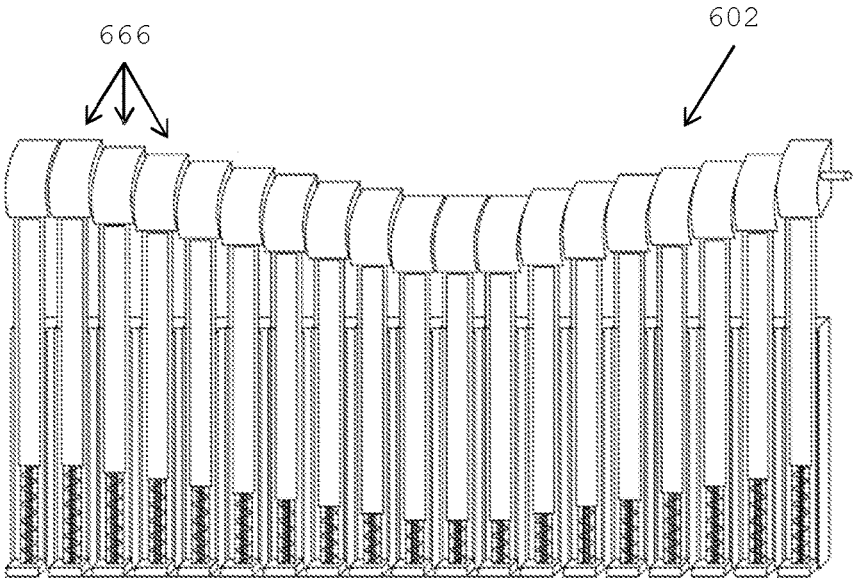
FIG. 15 shows a side view of a side of a bed according to a fifth embodiment of the invention, the side being formed by multiple side portions.

FIG. 15 shows a fifth embodiment of the invention comprising a bed frame 602. The bed frame 602 comprises a plurality side portions 666 arranged in a line to define, in use, a side of a bed. The side portions 666 operate in a similar way to the side portions 566 according to the fourth embodiment, the structure of the side portions 666 differing as set out below.

Figure 16:
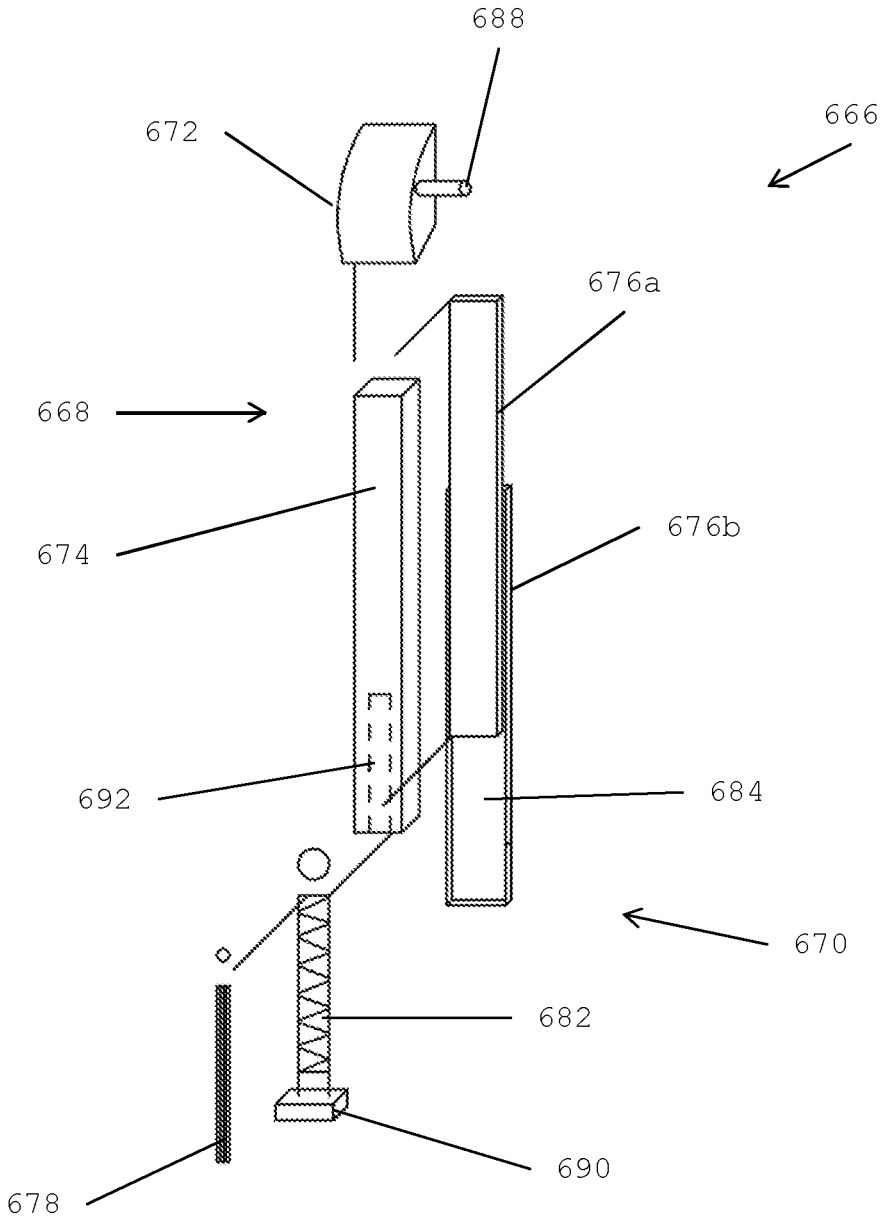
FIG. 16 shows an expanded view of one of the side portions shown in FIG. 15.

FIG. 16 shows an expanded view of a side portion 666. The side portion 666 comprises a movable side element 668 movably mounted to base element 670.

The movable side element 668 comprises an upper edge portion 672 having a pusher member 688 and groove, and an elongate body portion 674. A runner 676*a* is mounted to the rear of the body portion 674. In an alternative embodiment, the pusher member 688 and groove are instead provided on the body portion 674.

The base element 670 comprises a bottom portion 690 for sitting on the floor. A rear plate 684 extends upwardly from the bottom portion 690. The rear plate 684 comprises a corresponding runner 676*b* arranged to receive the runner 676*a* when the movable side element 668 is received by the base element 670.

A rod 678 is also mounted to the bottom portion 690 and projects vertically upwardly therefrom. A compression spring 682 is provided onto the rod 678. The rod 678 gives support to the spring 682.

The bottom of the body portion 674 comprises a vertically extending cavity 692 configured to receive the rod 678. The cavity 692 is configured such that the rod 678 can extend through the cavity 692 yet the spring is prevented from passing freely through the cavity. The spring 682 is received by a circular recess on a lower edge of the body portion 674.

In use, the moveable side element 668 is received by the base element 670, the runner 676*a* of the movable side element 668 being received by the runner 676*b* of the base element 684, and the rod 678 being received by the cavity 692.

Rear plates 684 are connected to each other, as seen in FIG. 15, to form a side of a bed. The pusher member 688 and groove of the upper edge portion 672 allow the movable side elements 668 of adjacent side portions 666 to interact in a similar manner to that described in relation to the fourth embodiment.

Figure 17:
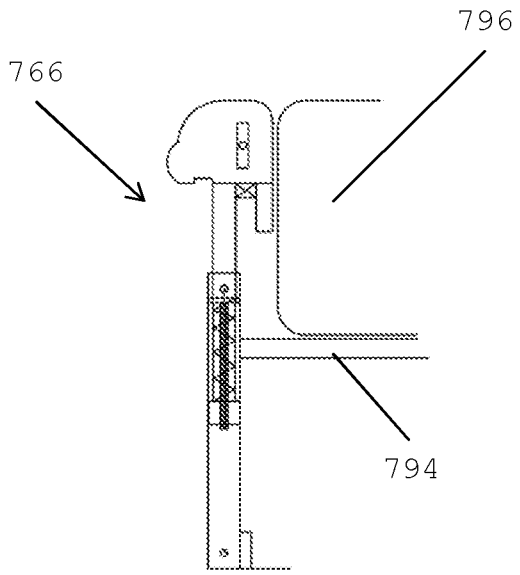
FIG. 17 is a side view showing the use, in accordance with a sixth embodiment of the invention, of the side portions of FIG. 14.

FIG. 17 shows a sixth embodiment of the invention, utilising the movable side portions as described above and shown in FIG. 14, but in relation to a traditional mattress 796. In this embodiment, a height adjustable horizontal support 794 is provided, which is arranged to receive the mattress 796 and which are adjustable to accommodate various mattress thicknesses. The resiliently mounted vertically moveable side portions 766 allow for comfort in getting on and getting off the bed.

Figure 18:
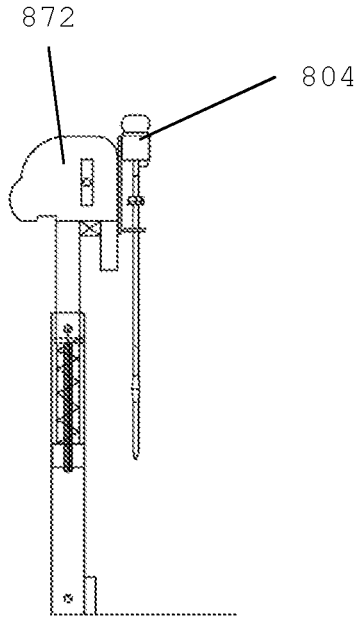
FIG. 18 is a side view showing the use, in accordance with a seventh embodiment of the invention, of the side portions of FIG. 14.

FIG. 18 shows a part of a bed according to a seventh embodiment, in which a support member 804 is mounted to the upper edge portion 872 of a movable side element of the bed. The support member 804 is one of many which together define the body support surface of the bed. Each support member is mounted for vertical movement in a similar manner to that described in relation to the first embodiment of the invention.

Figure 19:
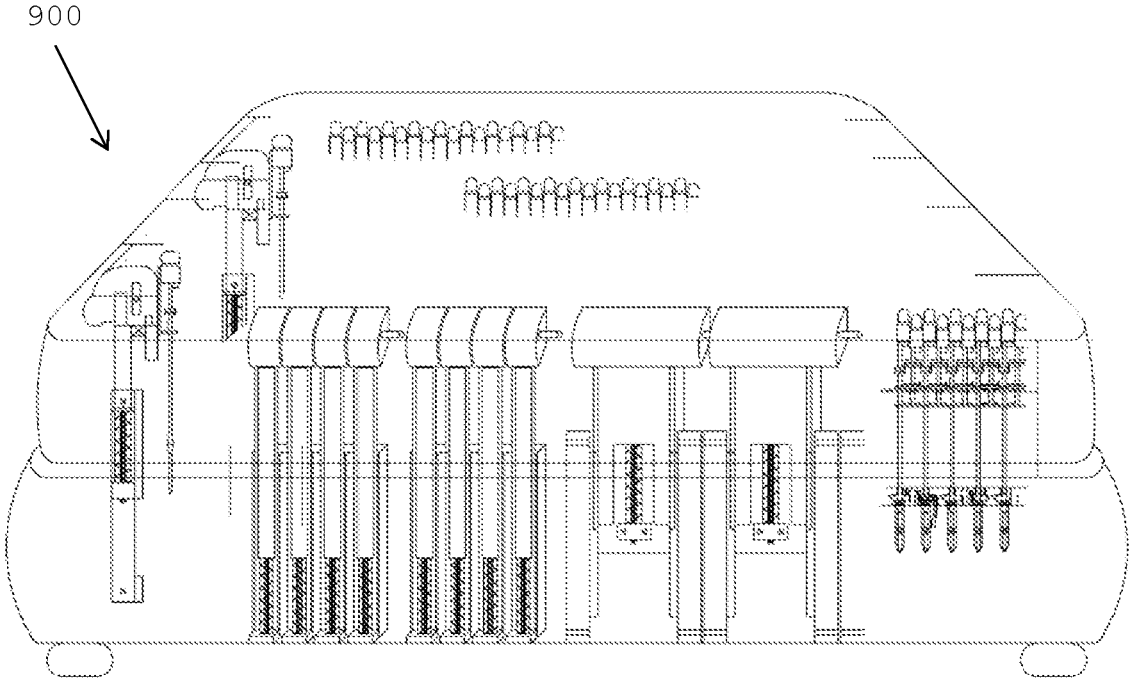
FIG. 19 shows a bed incorporating, for the sake of comparison, side portions according to the fourth embodiment of the invention and side portions according to the fifth embodiment of the invention.

FIG. 19 shows a bed 900 having a bed frame comprising a plurality of moveable side elements. The Figure shows both side elements according to the fourth and fifth embodiments of the invention, to allow the reader to see how each is incorporated into a bed and to allow for ease of comparison. It will be appreciated an actual embodiment of the bed of the present invention would, if movable side elements are provided, most likely have side elements according to only one or the other of the fourth and fifth embodiments of the invention. Support members according to the first and second embodiments of the invention are also shown in FIG. 19 to aid understanding of how the various above-described embodiments relate to each other. For clarity, the frame is only shown in part.

Figure 20:
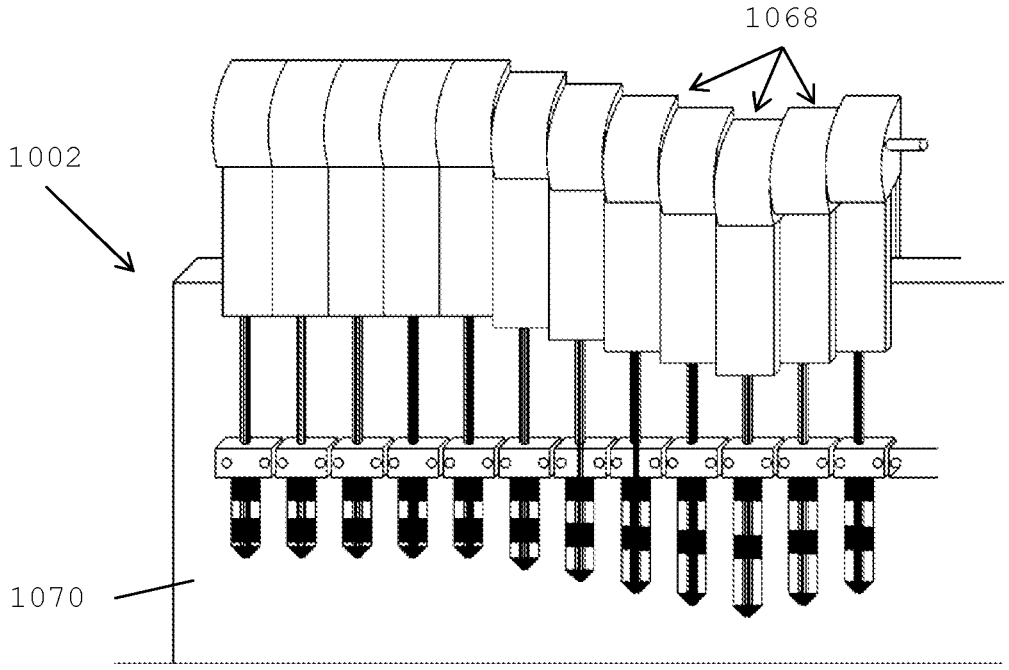
FIG. 20 shows a side view of a side of a bed according to an eighth embodiment of the invention.

FIG. 20 shows an eighth embodiment of the invention comprising a bed frame 1002. The bed frame 1002 comprises a plurality of movable side elements 1068 movably mounted on a side support structure 1070.

Figure 21:
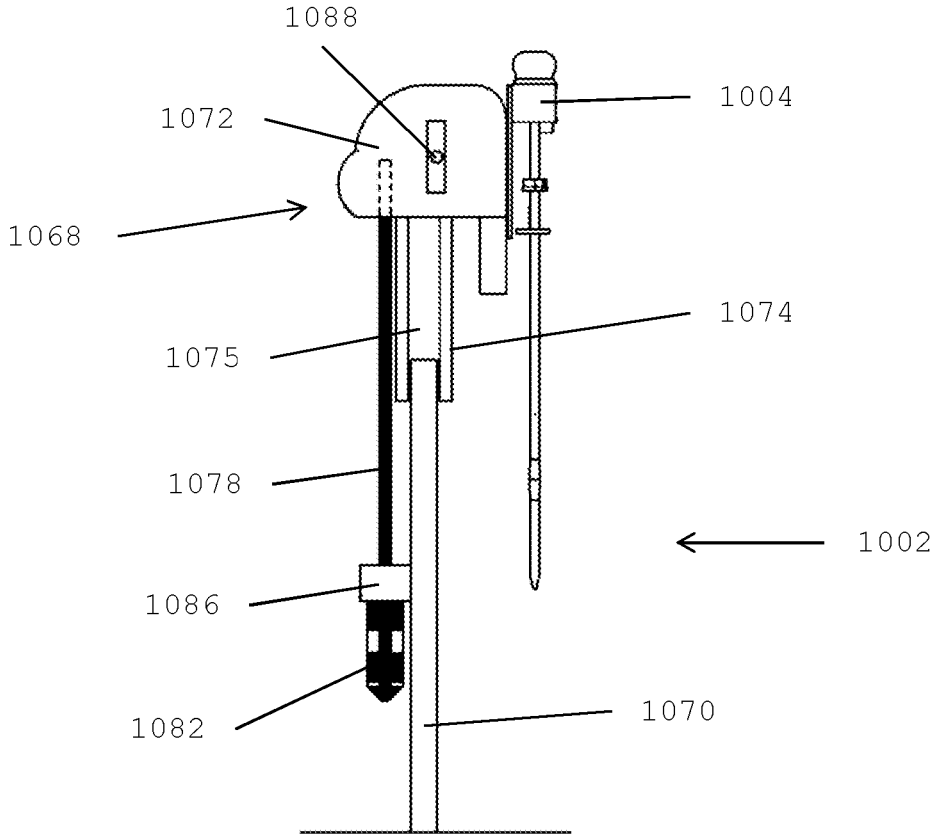
FIG. 21 shows a side view of a side element shown in FIG. 20.

As shown in FIG. 21, and similarly to the fourth and fifth embodiments, the movable side elements 1068 comprise an upper edge portion 1072 and a lower body portion 1074.

The lower body portion 1074 comprises an elongate slot 1075 which receives an upper edge of the side support structure 1070. Preferably runners or the like are provided to allow the lower body portion 1074 to move smoothly relative to the upper edge of the side support structure 1070.

The movable side elements 1068 also comprise a rod 1078 which is mounted to the upper edge portion 1072. The axis of the rod 1078 is vertical and extends beneath the upper edge portion 1072.

A spring support member 1086 is mounted to the side support structure 1070, in this case on the outside, that being on the opposite side of the side support structure 1070 to the mattress area (in an alternative arrangement the spring support member is mounted inside of the side support structure). The spring support member 1086 comprises a slot through which the rod 1078 extends. A tension spring 1082 is mounted to, and extends beneath, the spring support member 1086. The spring 1082 retains the lower end of the rod 1078 and acts to urge the rod, and therefore the movable side element 1068, upwards.

A plurality of the movable side elements 1068 may be mounted side by side along a side support structure 1070, as seen in FIG. 20, to form a side of a bed. The upper edge portion 1072 comprises a pusher member 1088 and groove. The pusher member 1088 and groove allow adjacent movable side elements 1068 to interact in a similar manner to that described in relation to the fourth and fifth embodiment.

The bed frame 1002 does not comprise modular side portions as per the fourth and fifth embodiments; however it could be readily envisaged that side support structure could be divided into a plurality of base elements which can be arranged to form a side of a bed.

Similarly to the seventh embodiment, support member 1004 is fixedly mounted to the upper edge portion 1072. Support member 1004 may be connected to a plurality of other support members to define a body support surface of a bed.

Whilst the present invention has been described and illustrated with reference to particular embodiments, it will be appreciated by those of ordinary skill in the art that the invention lends itself to many different variations not specifically illustrated herein. By way of example only, certain possible variations will now be described.

Only some of the edges of the bed may be provided with the movable side elements of the fourth or fifth or eighth embodiments. It may in certain designs of bed be preferred, for example, to have the lateral edges/sides of the bed formed of such movable side elements, but have fixed/rigid edges/sides at the head and the foot of the bed.

Whilst the present invention and embodiments thereof has been described and claimed with reference to beds, it may be that the invention has application in relation to other means for supporting at least part of a living human being. For example, the advantages of the present invention could be applied not only to beds, but also to chairs and other apparatus for supporting a person, or part of a person (for example, just their legs). There may therefore be provided a body support apparatus, that is, an apparatus suitable for supporting at least part of a living human being having the features of the bed of the invention as described or claimed herein, but not necessarily being in the form of a bed. Such a body support apparatus may be a bed, a chair and another apparatus capable of supporting a living human being or an animal having a mass greater than 1 Kg, or a part of such a human being or animal.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims. Moreover, it is to be understood that such optional integers or features, whilst of possible benefit in some embodiments of the invention, may not be desirable, and may therefore be absent, in other embodiments.

The invention claimed is:

1. A bed comprising a support surface defined by a plurality of support members, wherein:

each support member is mounted for movement in a direction substantially normal to the support surface;

at least some of the support members are resiliently urged towards an unloaded position by means of a spring;

a damping system is provided for damping vibrations of the spring;

the damping system is arranged to engage with the spring when the support member is in the unloaded position and to disengage with the spring when the support member is loaded; and the damping system comprises a damping arm engageable with the spring.

2. A bed according to claim 1, wherein the damping arm is pivotally mounted.

3. A bed according to claim 1, wherein the spring that is configured to resiliently urge the support member towards the unloaded position is a first spring, and wherein the bed further comprises a second spring arranged to resiliently urge the damping system towards a position in which the damping system is disengaged with the first spring.

4. A bed according to claim 1, wherein the support member comprises a formation and the damping system comprises a corresponding formation arranged to engage with the formation; the support member and damping system being configured such that engagement of the formation and the corresponding formation effects engagement of the damping system with the spring.

5. A bed according to claim 4, wherein the damping system comprises an engagement arm, the engagement arm comprising the corresponding formation.

6. A bed according to claim 4, wherein the formation and corresponding formation act as a stop preventing the support member from being pulled out of the bed.

7. A bed according to claim 1, wherein the support member comprises a shaft, an axis of the shaft being substantially normal to the support surface.

8. A bed according to claim 1, wherein the spring is a tension spring.

9. A bed according to claim 1, wherein the support member is retained in a guide element.

10. A bed according to claim 9, wherein the damping arm is pivotally mounted to the guide element.

11. A bed according to claim 9, wherein:

the guide element comprises a first part and a second part which define an aperture;

the spring is retained in the aperture; and the first part and second part comprise projections which are arranged to retain the spring by engaging between coils of the spring.

12. A bed according to claim 1, wherein at least a multiplicity of the support members are so arranged that movement of any one of those support members in a direction substantially normal to the support surface and beyond a threshold distance relative to an adjacent support member causes movement of said adjacent support member in substantially the same said direction, there being substantially no movement of said adjacent support member caused by the movement of said any one of those support members when the distance of relative movement is below the threshold distance.

13. A bed according to claim 12, wherein:

at least some of the support members are provided with a laterally extending pusher member, wherein the pusher member comprises an engagement surface arranged to engage with adjacent support members so as to cause them to move, the engagement surface comprising damping material.

14. A bed according to claim 13, wherein the damping material is a polymeric material.

15. A damping system for use in the bed according to claim 1.

16. A bed according to claim 1, wherein the damping arm comprises a spring engagement surface comprising a resilient damping material.

17. A bed according to claim 16, wherein the damping material comprises one or more of the group consisting of a polymeric material, soft plastic, rubber, neoprene, foam, and felt.

18. A bed comprising a support surface defined by a plurality of support members, wherein:

each support member is mounted for movement in a direction substantially normal to the support surface;

at least some of the support members are resiliently urged towards an unloaded position by means of a spring;

a damping system is provided for damping vibrations of the spring;

the damping system is arranged to engage with the spring when the support member is in the unloaded position and to disengage with the spring when the support member is loaded;

the support member is retained in a guide element comprising a first part and a second part which define an aperture;

the spring is retained in the aperture; and the first part and second part comprise projections which are arranged to retain the spring by engaging between coils of the spring.

* * * * *